US011661221B2

(12) United States Patent
Scott et al.

(10) Patent No.: US 11,661,221 B2
(45) Date of Patent: May 30, 2023

(54) VACUUM EXTRACTION AND SEALING OF CONTAINERS

(71) Applicant: PLF International Limited, Harwich (GB)

(72) Inventors: Peter Roy Scott, Colchester (GB); Mark Emond, Harwich (GB)

(73) Assignee: PLF International Limited, Ardleigh (GB)

( * ) Notice: Subject to any disclaimer, the term of this patent is extended or adjusted under 35 U.S.C. 154(b) by 83 days.

(21) Appl. No.: 17/445,997

(22) Filed: Aug. 26, 2021

(65) Prior Publication Data

US 2021/0387760 A1 Dec. 16, 2021

Related U.S. Application Data

(62) Division of application No. 16/212,039, filed on Dec. 6, 2018, now Pat. No. 11,117,696.

(Continued)

(51) Int. Cl.

| | |
|---|---|
| ***B65B 31/04*** | (2006.01) |
| ***B65B 31/02*** | (2006.01) |
| ***B65B 31/06*** | (2006.01) |

(52) U.S. Cl.

CPC ..... *B65B 31/044* (2013.01); *B65B 31/028* (2013.01); *B65B 31/06* (2013.01)

(58) Field of Classification Search

CPC ..... B65B 31/044; B65B 31/028; B65B 31/06

See application file for complete search history.

(56) References Cited

U.S. PATENT DOCUMENTS 782,203 A * 2/1905 Norton ..... B65B 31/025 413/4

831,527 A * 9/1906 Landsberger ..... B65B 31/025 53/85

(Continued)

FOREIGN PATENT DOCUMENTS

CA 1 198 396 A 12/1985

CN 103010513 A 4/2013

(Continued)

OTHER PUBLICATIONS

Examination Report dated Oct. 15, 2020, issued in corresponding Australian Patent Application No. 2021204648, filed Dec. 6, 2018, 6 pages.

(Continued)

*Primary Examiner* — Nathaniel C Chukwurah

*Assistant Examiner* — Lucas E. A. Palmer

(74) *Attorney, Agent, or Firm* — Christensen O'Connor Johnson Kindness PLLC

(57) ABSTRACT

A system for evacuating and sealing containers filled with product, for example, food product, includes an enclosed, sealed housing wherein the pressure level and the atmospheric content can be controlled. A vacuum shroud is positioned in registry with a container entrance opening in the housing, the shroud connectible to a vacuum source and to a source of replaceable gas to replace the ambient air to be removed from the container. The shroud is advanceable to seal the container entrance opening and is retractable from the container entrance opening. A container transport system inserts the container through the housing entrance opening and into the shroud. Thereupon, a sealing system seals the housing from the ambient after the container has been inserted into the shroud. After the air in the container has been replaced with an inert gas and then the shroud retracted, a closure subsystem applies a cover to the evacu- (Continued)

ated container. Thereafter, an out feed subsystem removes the closed container from the housing while maintaining the atmospheric content and pressure level within the housing.

17 Claims, 27 Drawing Sheets

Related U.S. Application Data

(60) Provisional application No. 62/596,632, filed on Dec. 8, 2017.

(56) References Cited

U.S. PATENT DOCUMENTS

| | | | | |
|---|---|---|---|---|
| 1,679,386 | A | 8/1928 | Tenney | |
| 1,801,062 | A | 4/1931 | White et al. | |
| 2,973,609 | A | 3/1961 | Morgan, Jr. | |
| 3,191,354 | A | 6/1965 | McElroy et al. | |
| 3,220,153 | A * | 11/1965 | Cormack, Jr. | B67B 3/24 53/474 |
| 3,354,608 | A | 11/1967 | Hart et al. | |
| 3,605,826 | A * | 9/1971 | Carter | B65B 31/025 141/93 |
| 3,785,410 | A * | 1/1974 | Carter | B65B 31/044 141/69 |
| 4,035,982 | A * | 7/1977 | Paules | B65B 1/46 53/442 |
| 4,104,153 | A | 8/1978 | Erickson | |
| 4,140,159 | A | 2/1979 | Domke | |
| 4,154,044 | A * | 5/1979 | Lang | B65B 31/025 53/97 |
| 4,221,102 | A * | 9/1980 | Lang | B65B 31/025 53/101 |
| 4,312,171 | A | 1/1982 | Vadas | |
| 4,513,015 | A | 4/1985 | Clough | |
| 5,069,020 | A | 12/1991 | Sanfilippo et al. | |
| 5,417,255 | A | 5/1995 | Sanfilippo et al. | |
| 5,896,727 | A | 4/1999 | Egli et al. | |
| 6,457,299 | B1 | 10/2002 | Schwenke et al. | |
| 6,725,632 | B2 | 4/2004 | Glucksman et al. | |
| 7,357,615 | B2 * | 4/2008 | Rudd | B21D 51/32 413/31 |
| 7,690,404 | B2 * | 4/2010 | Marcus | B65B 31/041 141/85 |
| 10,774,195 | B2 | 9/2020 | Hamidinejad et al. | |
| 10,782,203 | B2 | 9/2020 | Pillar | |
| 10,831,527 | B2 | 11/2020 | Leitner | |
| 2002/0010164 | A1 | 1/2002 | Abrahamson et al. | |
| 2006/0248860 | A1 | 11/2006 | Liao | |
| 2007/0062162 | A1 | 3/2007 | Lehmann | |
| 2007/0107384 | A1 | 5/2007 | Capelli et al. | |
| 2008/0152767 | A1 | 6/2008 | Maisel | |
| 2015/0266600 | A1 * | 9/2015 | Haimi | B65B 31/046 53/404 |
| 2020/0079635 | A1 * | 3/2020 | Yuse | B67C 7/0053 |

FOREIGN PATENT DOCUMENTS

| | | | | |
|---|---|---|---|---|
| CN | 204508754 | U | 7/2015 | |
| CN | 105836686 | A | 8/2016 | |
| CN | 106347767 | A | 1/2017 | |
| EP | 0566173 | A1 | 10/1993 | |
| GB | 2086834 | A * | 5/1982 | B65B 31/00 |
| GB | 2490720 | B | 11/2012 | |
| WO | 95/31375 | A1 | 11/1995 | |
| WO | 2013/009226 | A1 | 1/2013 | |
| WO | 2015/121266 | A1 | 8/2015 | |
| WO | 2017/033454 | A1 | 3/2017 | |

OTHER PUBLICATIONS

Third Party Observations dated Sep. 13, 2022, issued in corresponding European Patent Application No. 20163902.8, filed Dec. 6, 2018, 7 pages.

Communication dated Jan. 13, 2022, issued in corresponding European Application No. 20 163 902.8-1016, filed Dec. 6, 2018, 5 pages.

Second Office Action dated Dec. 30, 2021, issued in corresponding Chinese Application No. 202010404136.4, filed Dec. 6, 2018, 16 pages.

International Search Report and Written Opinion dated Mar. 14, 2019, issued in corresponding International Application No. PCT/EP2018/083771, filed Dec. 6, 2018, 13 pages.

Examination Report dated Jul. 3, 2020, issued in corresponding Australian Patent Application No. 2020202986, filed Dec. 6, 2018, 7 pages.

Examination Report dated Oct. 15, 2020, issued in corresponding Australian Patent Application No. 2020202986, filed Dec. 6, 2018, 5 pages.

Examination Report dated Nov. 26, 2020, issued in corresponding New Zealand Patent Application No. 762923, filed Dec. 6, 2018, 5 pages.

Communication dated Dec. 18, 2020, issued in corresponding European Patent Application No. 20 163 902.8, filed Dec. 6, 2018, 4 pages.

Examination Report dated Dec. 18, 2020, issued in corresponding Australian Patent Application No. 2018379447, filed Dec. 6, 2018, 5 pages.

Communication dated Feb. 19, 2021, issued in corresponding European Patent Application No. 18819034.2, filed Dec. 6, 2018, 6 pages.

Office Action dated May 6, 2021, issued in corresponding Chinese Patent Application No. 202010404136.4, filed Dec. 6, 2018, 12 pages.

Notice of First Office Action dated Jun. 2, 2021, issued in corresponding Chinese Patent Application No. 201880068633.2, filed Dec. 6, 2018, 9 pages.

Communication dated Jul. 6, 2021, issued in corresponding European Application No. 20 163 902.8-1016, filed Dec. 6, 2018, 4 pages.

Extended European Search Report dated May 19, 2020, issued in corresponding European Patent Application No. 20163902.8, filed Dec. 6, 2018, 7 pages.

Notice of Second Office Action dated Feb. 8, 2022, issued in corresponding Chinese Patent Application No. 201880068633.2, filed Dec. 6, 2018, 12 pages.

Communication dated Mar. 9, 2023, issued in corresponding European Application No. 20 163 902.8, filed Dec. 6, 2018, 4 pages.

* cited by examiner

VACUUM EXTRACTION AND SEALING OF CONTAINERS

CROSS-REFERENCES TO RELATED APPLICATIONS

This application is a division of U.S. patent application Ser. No. 16/212,039, filed Dec. 6, 2018, which claims the benefit of U.S. Provisional Application No. 62/596,632, filed Dec. 8, 2017, the disclosures of both of which are hereby expressly incorporated by reference herein in their entireties.

BACKGROUND

The present disclosure pertains to extracting oxygen from filled containers by vacuum process and replacing the oxygen with an inert gas and then sealing the container. The container may be composed of metallic cans, glass jars or bottles or PET or other containers capable of withstanding reduced pressure within the container.

Current systems for the vacuum extraction of air/oxygen from containers and then sealing the containers include large, high production systems with as many as 30 filling heads operating simultaneously. Such machines are very expensive and not practical for most production settings where several or many different types of products are sealed within cans, bottles, or other types of containers.

At the other end of the spectrum are slow-speed machines for vacuum extraction of a container and subsequent sealing of the container. Such machines often require that one or more probes be inserted into the substance of the container, typically a powder, to create holes in the powder to assist in extraction of the oxygen within the powder. The drawback of requiring the use of such probes is contamination of the powder within the container, especially if food by insertion of the probes.

Another drawback of such machines is that when vacuum is applied to extract the air/oxygen from the container, some of the powder or other substance within the container is also extracted, thereby resulting in a loss of product from each container.

The present disclosure seeks to provide an apparatus and method for vacuum extraction of ambient oxygen from containers, the replacement of such oxygen with an inert gas or gas mixture and then the sealing of containers, all at a production rate that is practical for a large segment of the industry, as well as scalable to both increase or decrease production rates.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A system for evacuating and closing containers filled with powdered content or other content includes an enclosed housing which is in communication with a vacuum source to remove the air or ambient gas in the housing and replace the removed air or gas with an inert replacement gas which contains no or very little oxygen. The housing has at least one entrance opening for receiving the containers therein to be evacuated and then closed.

A vacuum shroud is in registry with the container entrance opening in the housing. The shroud also is connected to a vacuum source as well as the source of replacement gas to replace the ambient air removed from the container with an inert gas. The shroud is movable between advancing the shroud to seal the container entrance opening with the shroud and retracting the shroud from the container entrance opening.

A container transport system is used to insert the container through the housing entrance opening and into the shroud. A sealing system seals the housing from the ambient after the container is inserted into the shroud. The sealing system may be incorporated into the structure of the container transport system.

The system also includes a closure subsystem for closing the containers once the ambient air is removed from the container and replaced with a substantially oxygen free replacement gas. Thereafter, an outfeed subsystem removes the closed containers from the housing while maintaining the atmospheric content and pressure level within the housing. The outfeed subsystem may include a suitable exit chamber for receiving the closed container from the housing while maintaining the vacuum level and atmospheric composition within the housing. A conveyor may be used to remove the closed container from the exit chamber and transport the closed container away from the housing.

The shroud includes a closed proximal end and an open distal end through which the container is received into the shroud. The distal end of the shroud is sealable relative to the entrance opening of the housing when the shroud is advanced into container receiving position at the container entrance opening of the housing. The shroud also includes an actuator to advance the shroud to seal the distal end of the shroud relative to the housing entrance opening as well as to retract the shroud away from the housing entrance opening after the air in the container has been replaced so that the container may be transferred to a sealing station for placing a cover or lid over the container and seaming the cover to the top of the container.

The container transport system may include a movable platform to advance the platform when inserting the container through the housing entrance opening and into the interior of the shroud. The platform is used to seal the housing entrance opening when the container is placed into the interior of the shroud. An actuator is provided to advance and retract the platform forward and away from the housing entrance opening.

The closure system places a closure in the form of a cover or lid over the open end of the container. The closure system thereafter seals the cover or lid to the container. Prior to such sealing, the pressure within the filled container can be reduced to a level below the pressure within the housing so as to provide a reduced pressure level within the container when sealed.

A cover/lid supply magazine is in communication with the housing to supply covers/lids for the containers to be closed. The cover/lid supply magazine provides a seal between the interior of the housing from the ambient so that the housing is not exposed to the ambient via the cover/lid supply magazine.

A method is provided for evacuating and closing containers filled with powdered material and other content wherein the air removed from the containers is replaced by an inert gas that is substantially devoid of oxygen. The method is performed in an enclosed housing having an entrance opening for receiving the container. A shroud is positioned over the entrance opening within the housing thereby sealing the entrance opening from the ambient. Ambient air is removed from the housing and replaced with the inert gas substantially free of oxygen. Thereafter, the container is presented through the housing entrance opening and into the shroud. Then, the housing entrance opening is sealed from the ambient thereby isolating the interior of the shroud with the container therein. Next, the ambient air is removed from the container by applying a vacuum to the shroud. The removed ambient air is replaced with an inert gas that corresponds to the inert gas of the housing.

Thereafter, the shroud is retracted so that the container can be moved to a location within the housing for closing the container, for example, by applying a cover or lid to the open top of the container and then seaming the lid to the container. Then the closed container is removed from the housing using an airlock or other system to maintain the inert gas composition and pressure level within the housing.

In accordance with the present method, when the container is presented to the housing entrance opening and into the shroud, the housing entrance opening and the shroud are simultaneously sealed from the ambient.

In accordance with the present method, the container is presented to the housing entrance opening using a linear actuator. More specifically, the container is supported on a platform that is powered by a linear actuator. Further, the platform is used to seal the container entrance opening from the ambient.

The housing can include an entrance opening that is capable of receiving a plurality of containers at the same time. As an alternative, the housing may include an entrance opening for each of the plurality of containers simultaneously presented to the housing. Whether the housing includes an entrance opening large enough for a plurality of containers or employs individual housing openings for each container, the housing opening(s) is/are sealed by engagement with the container platform(s).

The present method also includes conveying the container(s) from a filling station to the housing.

The method further includes entrapping the contents of the container during the evacuation of the container. In this regard, a pervious barrier may be placed over the open top of the container during the evacuation process as well as during the process of replacing the evacuated air with an inert gas.

During the evacuation process, the pressure within the container may be reduced to a level of about 10 to 20 mbar. More specifically, the pressure within the container may be reduced to a level of about 15 mbar.

The present method includes removing the shroud from the evacuated container and thereafter closing the top of the container while the container is within the housing. During the closure process, the pressure within the container can be reduced to a level below the pressure level within the housing so as to achieve an evacuated or partially evacuated container prior to the sealing of the container. The container may be sealed with a cover or lid that is seamed onto the container in a standard manner.

After sealing the container, the container is removed from the housing while maintaining the pressure and the inert atmosphere within the housing. This can be accomplished by transferring the sealed container from the housing via an airlock. The filled container is transferred to the airlock and thereafter the airlock is isolated from the housing before the container is removed from the airlock and transported on.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
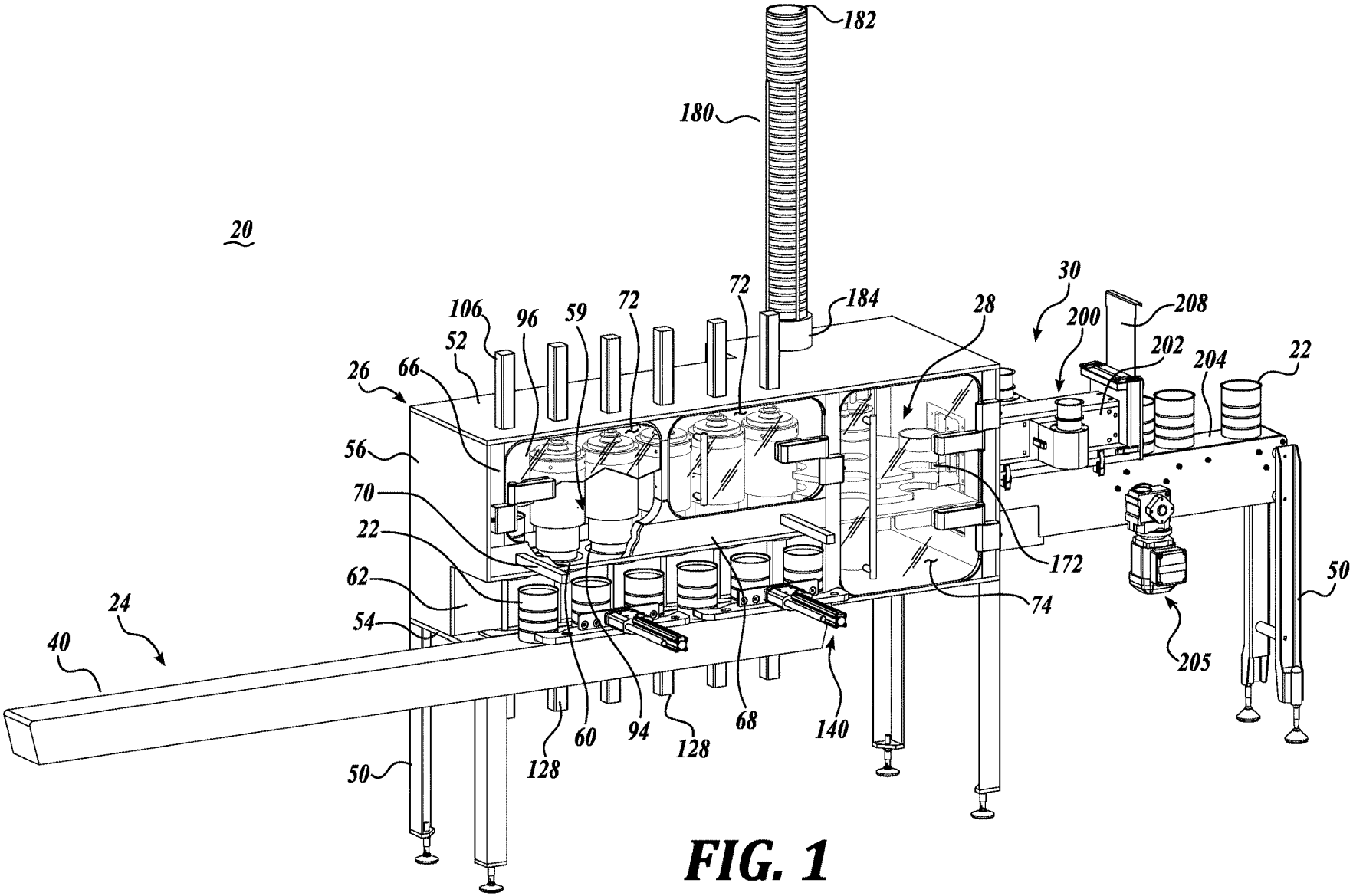
FIG. 1 is a pictorial view of the system of the present disclosure taken from a first or front side of the evacuation housing/chamber, and shown partially in schematic.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "upward," "downward," "right hand," "left hand," "in,"

"out," "extended," "advanced," "retracted," "proximal," "distal," "above," "below," "in front of," "behind," "on top of," and "beneath." These references and other similar references with respect to direction, position, location, etc., in the present application are only to assist in helping describe and understand the present invention and are not intended to limit the present invention to these directions, positions, locations, etc.

The present application may include modifiers such as the words "generally," "substantially," "about," or "approximately." These terms are meant to serve as modifiers to indicate that the "dimension," "shape," or other physical parameter, in question need not be exact, but may vary as long as the function that is required to be performed can be carried out. For example, in the phrase "generally circular in shape," the shape need not be exactly circular as long as the required function of the structure in question can be carried out.

In the following description, various embodiments of the present disclosure are described. In the following description and in the accompanying drawings, the corresponding systems assemblies, apparatus and units may be identified by the same part number, but with an alpha suffix. The descriptions of the parts/components of such systems assemblies, apparatus, and units are the same or similar are not repeated so as to avoid redundancy in the present application.

Referring initially to FIGS. 1-6, a system 20 for evacuating and sealing containers 22 filled with product, especially powdered product, is illustrated as including in basic form a transport and delivery system 24 for transporting and presenting a plurality of containers 22 to a sealed housing or chamber or enclosure 26 wherein atmospheric air is removed from the containers and replaced by an inert gas and then the containers are sealed at a closure station 28 thereby to preserve the contents within the containers. Thereafter, the closed containers are removed from the housing 26 by a removal system 30 for removing the closed containers from the housing without exposing the interior of the housing to the ambient. The containers 22 are illustrated in the form of cans, but can be of other configurations as noted below.

Describing the system 20 in more detail, the transport and delivery system 24 includes an infeed conveyor 40 that transports a set of containers 22 (six being illustrated as an example) from an escapement, not shown, associated with a filling station, not shown, wherein the cans are filled, typically with a powder, granular substance or similar, or other content. The plurality of containers are loaded onto the conveyor 40 from the escapement and then the conveyor is operated to position the cans 22 adjacent the infeed location at a lower level of housing 26. An optical or other type of sensor is utilized to count the number of cans transferred from the escapement onto the conveyor and determine the locations of such containers. Also, an encoder associated with conveyor 40 stops the conveyor when the containers 22 are in position at the housing as shown in FIGS. 1, 3, 5, and 6.

The housing/chamber 26 is illustrated as an enclosed structure that is sealed from the ambient. The structure 26 is supported by floor-engaging legs 50 depending from the bottom of the housing and from the removal system 30. The housing is illustrated as generally rectilinear in shape, but can be of other shapes. In this regard, the housing includes a top panel 52 and a bottom panel 54 interconnected by end panels 56 and 58. At the location that the containers 22 are presented to the housing 26 the lower portion of the housing is cut away to define a mezzanine 59 formed by a horizontal base plate 60. A vertical longitudinal wall 62, that intersects the inward edge of the base plate, and a transverse end wall 64 cooperatively seal off the mezzanine section of the housing from the ambient.

A side panel structure 66, which is mostly open in construction, is disposed along the side of the housing where the containers 22 are presented. Such side panel structure 66 does include a footing panel 68 through which upper actuators 70 extend, as described more fully below. A pair of see-through doors 72 are positioned above the footing panel 68 and a third full height see-through door 74 is located along the side panel structure 66. The doors 72 and 74 are sealed with respect to the side panel structure 66 so as to prevent leakage of gases between the interior of the housing and the ambient, while being of sufficient structural integrity to remain rigid and not deform during use of the system 20. To this end, the doors may be composed of a clear/transparent plastic or a glass composition, for example, acrylic or poly(methyl methacrylate). As will be appreciated, the doors 72 and 74 not only provide visibility into the housing 26, but also may be opened to provide access to the interior of the housing, for example, for cleaning, adjustment, maintenance, and repair, as well as to reconfigure the system 20 for use with other types or sizes of containers, etc.

Figure 2:
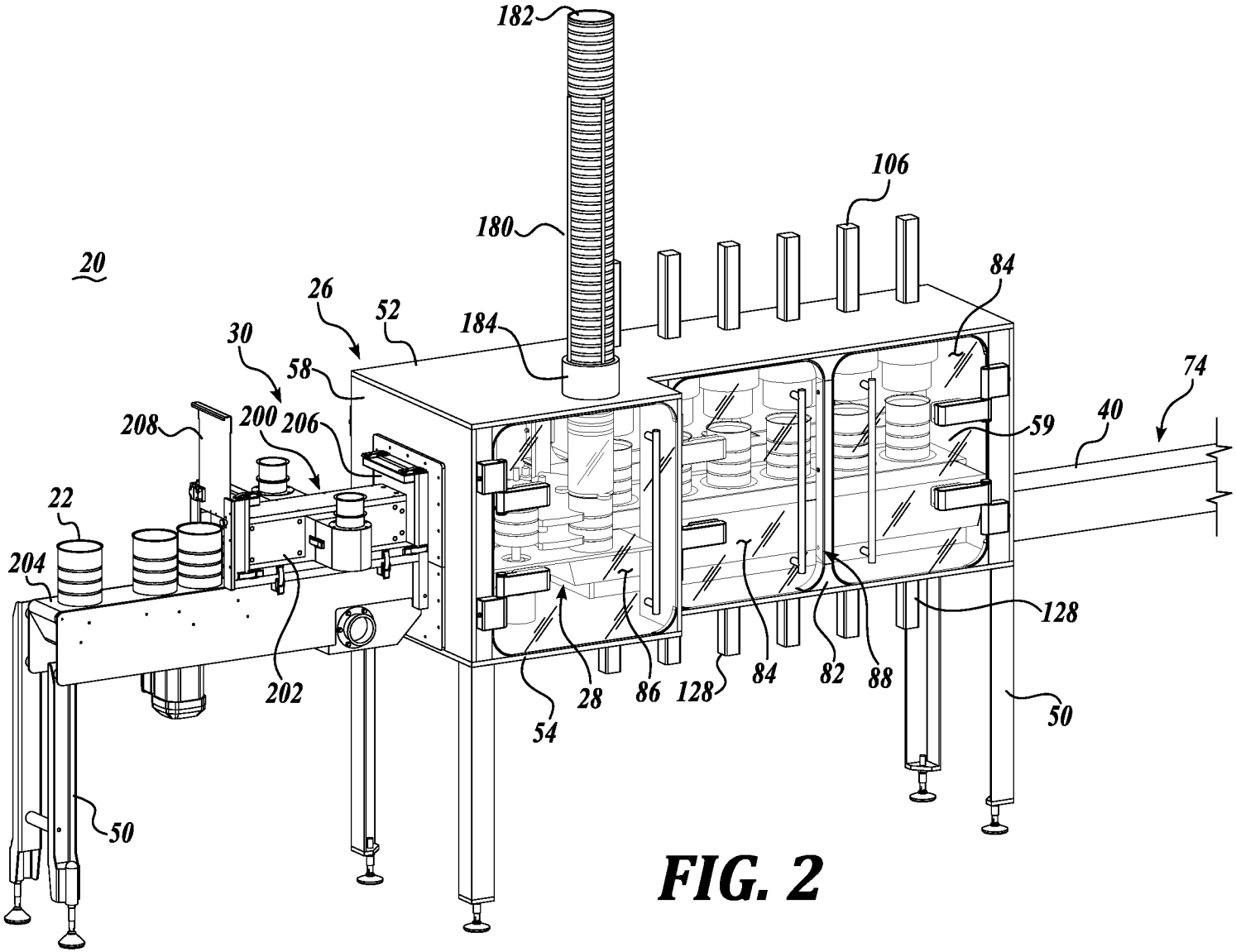
FIG. 2 is a view similar to FIG. 1, but taken from the opposite or back side of the evacuation housing as shown in FIG. 1.
Figure 4:
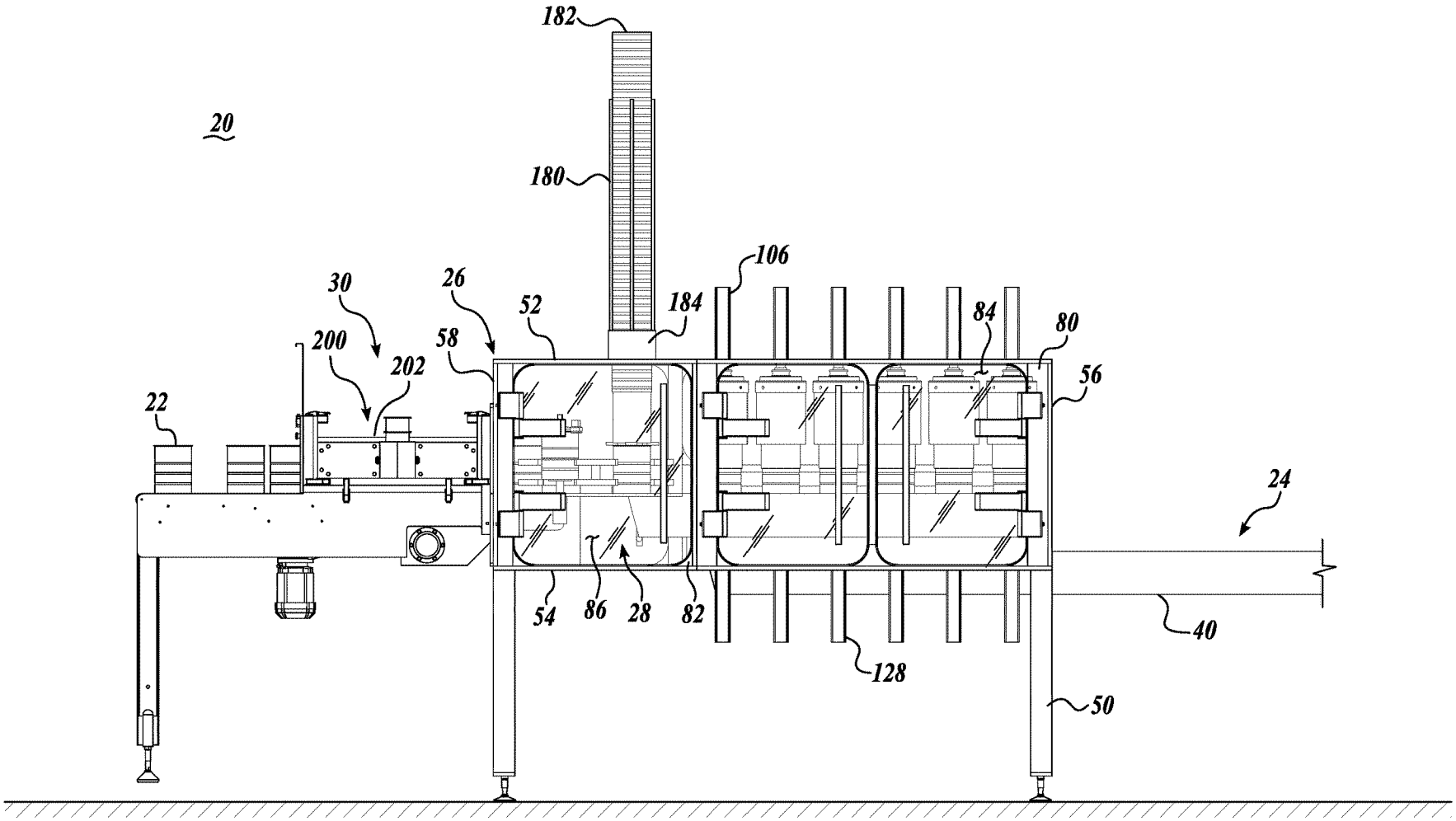
FIG. 4 is a side elevational view of FIG. 2.

Referring specifically to FIGS. 2 and 4, the "backside" of the housing is illustrated as composed of side panel structures 80 and 82 to which are fitted see-through doors 84 and 86, respectively. The doors 84 and 86 may be of the same composition as doors 72 and 74. The door 86 is located somewhat laterally outwardly from the doors 82 and 84. A step wall 88 extends laterally outwardly from the side panel 80 to define the housing at that location. The doors 84 provide access to the location in which the air/oxygen is removed from the containers and replaced with inert gas. The door 86 is adjacent the location in which the closure system 28 is located, which is described more fully below.

As perhaps most clearly shown in FIGS. 6, 7A-7H, and 8A-8C, a circular seal ring 87 depends downwardly from base plate 60. The top of the seal ring 87 is flush with the top surface of the base plate. In this regard, a shoulder extends around the circumference of the seal ring to abut against the lower surface of the base plate 60. As described more clearly below, the seal ring 87 has a central through bore or opening 94 through which containers 22 are delivered into the interior of the housing 26.

A shroud assembly 96 is associated with each of the sealing rings 87 and associated opening 94. Each shroud assembly 96 includes a shroud 98 having a cylindrical, major, upper sidewall portion 100 and a lower reduced outer diameter pilot section 89. The shroud upper sidewall section 100 is downwardly engageable within a counter bore 90 formed at the upper portion of the sealing ring 87, and the lower pilot section 89 of the shroud 98 closely engages within the sealing ring central opening or bore 94.

An upper seal 91 is disposed within a lateral groove opening into the seal ring counter bore 90 to seal against the outer circumference of the shroud sidewall section 100. An intermediate seal 92 likewise is disposed within a lateral groove formed in the sealing ring 87 to bear against the pilot portion 89 of the shroud sidewall.

The top of the shroud is closed by a top assembly 102, while the bottom of the shroud at the bottom of the pilot section 89 is open. The shroud 98 is raised and lowered by an actuator 106 connected to the shroud top assembly 102.

Referring specifically to FIGS. 6, 7A-7H, 8B, and 8C, a circular lift platform or table 120 is associated with each seal ring 87 and opening 94. The lift platforms 120 function to lift the filled containers 22 upwardly through the sealing ring opening 94 and into the interior of a shroud 98. The lift platform 120 includes an upper circular base section 122 that is sized to closely fit into the circular interior of the shroud. The lift platform also includes a slightly enlarged diameter lower shoulder section 124 which closely fits within the sealing ring opening or bore 94. The lift platform shoulder section 124 seals against a lower seal 93 that is mounted in a lateral groove formed in the lower portion of the seal ring to seal against the lower shoulder section 124 of the lift platform. The lift platform is raised and lowered by a lift actuator 128 extending downwardly from the underside of the lift platform 120.

Figure 7A:
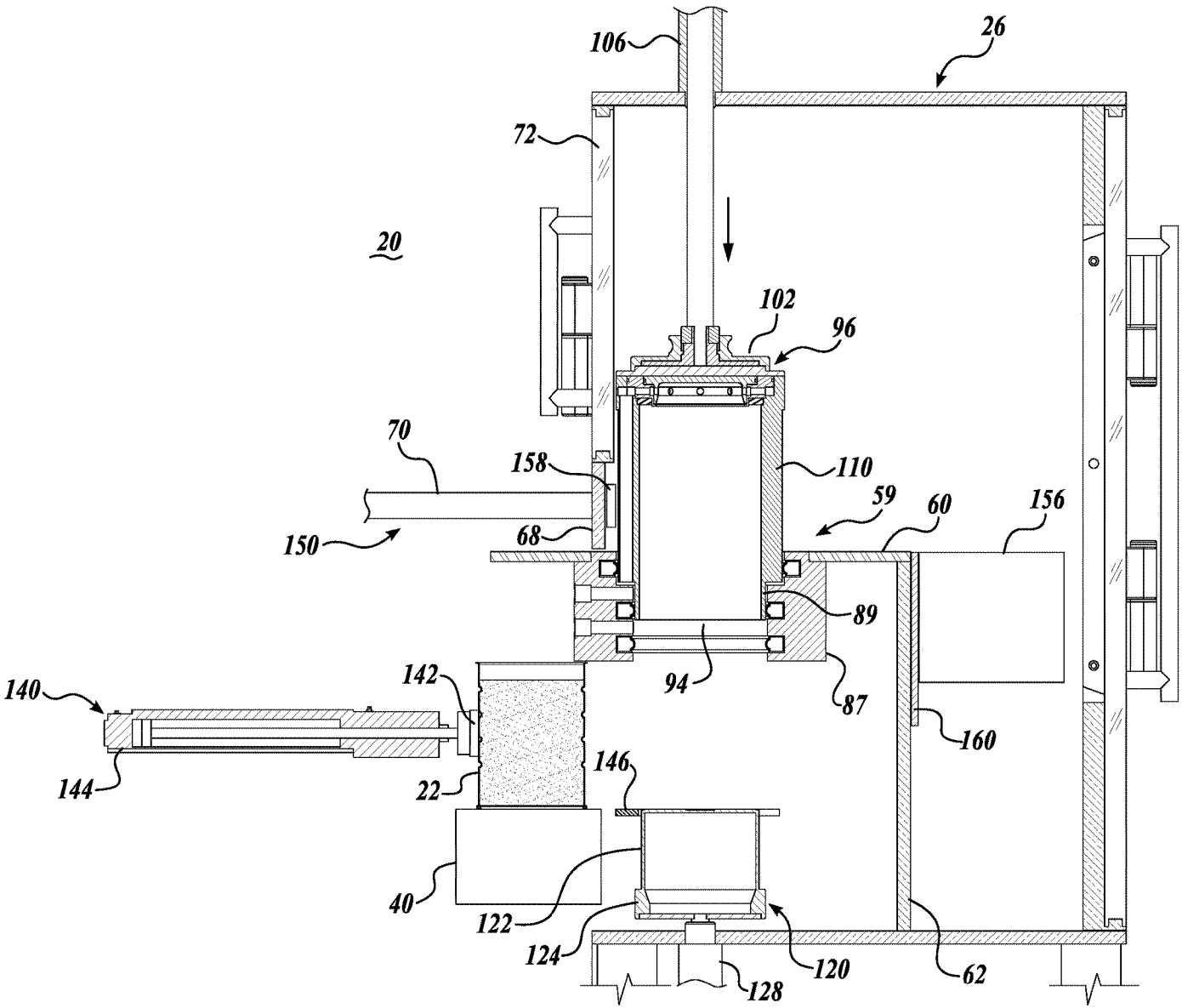
FIGS. 7A-7H illustrate one example of a method using the system of the present disclosure.
Figure 7B:
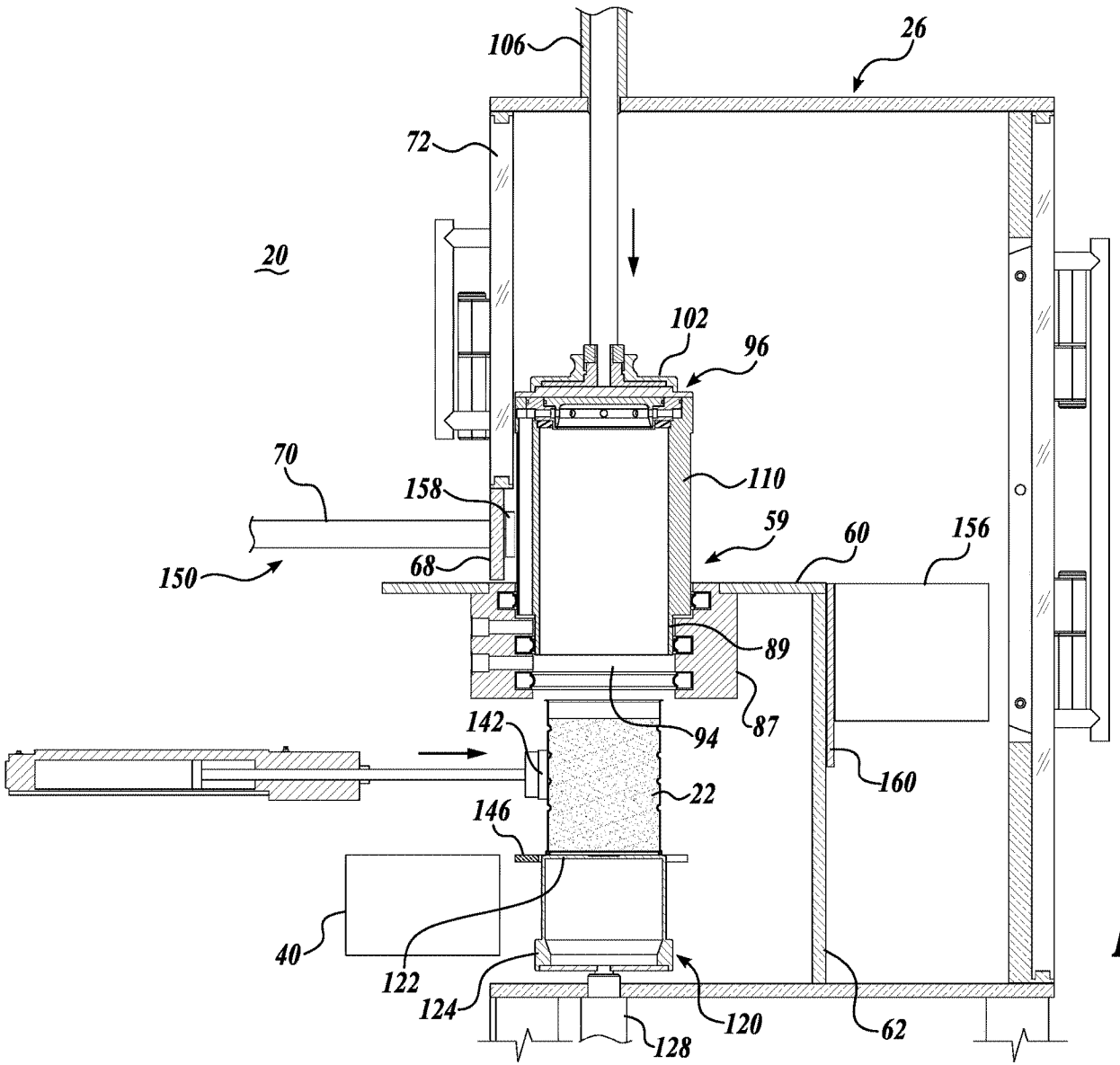
Figure 7C:
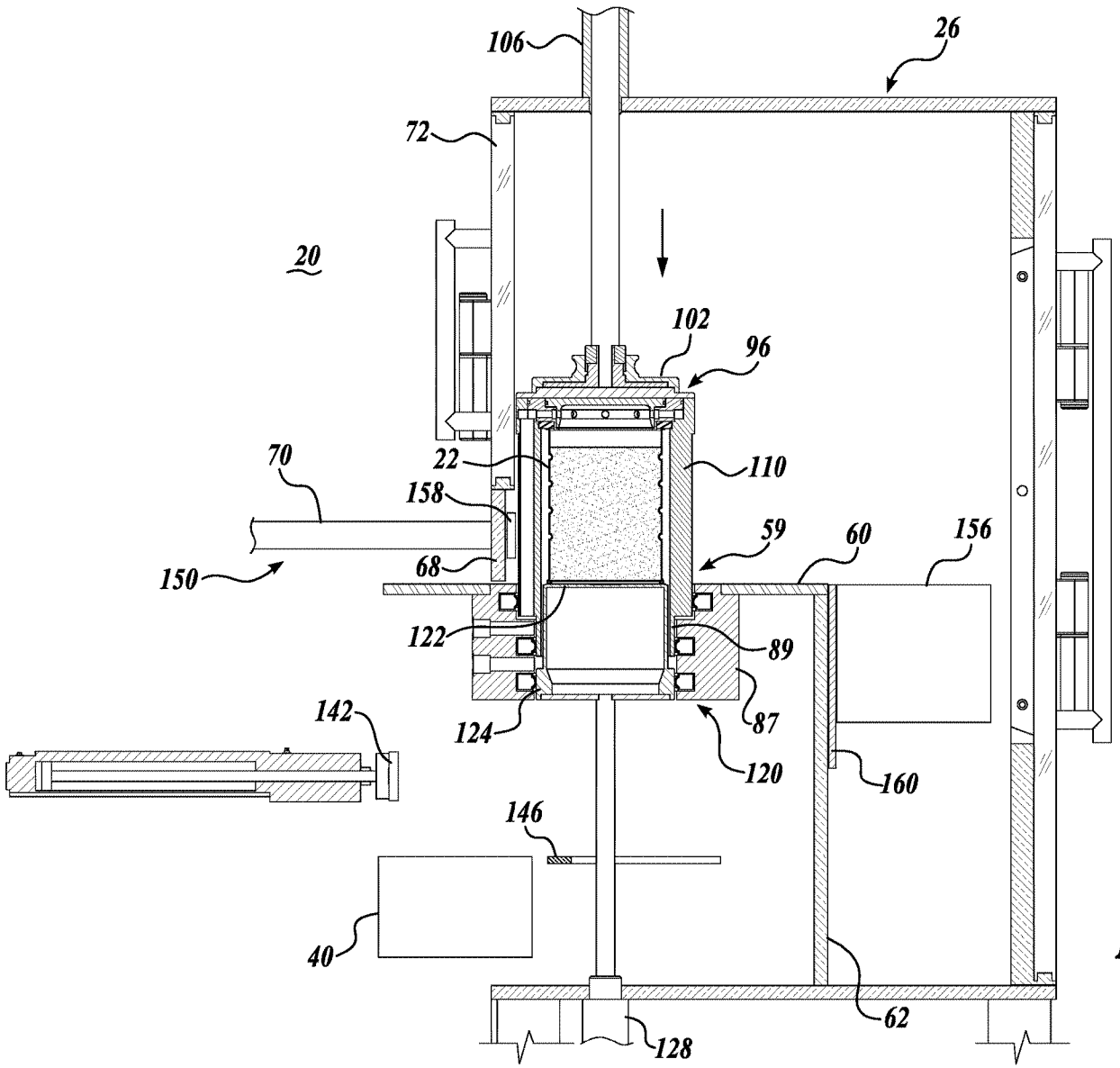
Figure 7D:
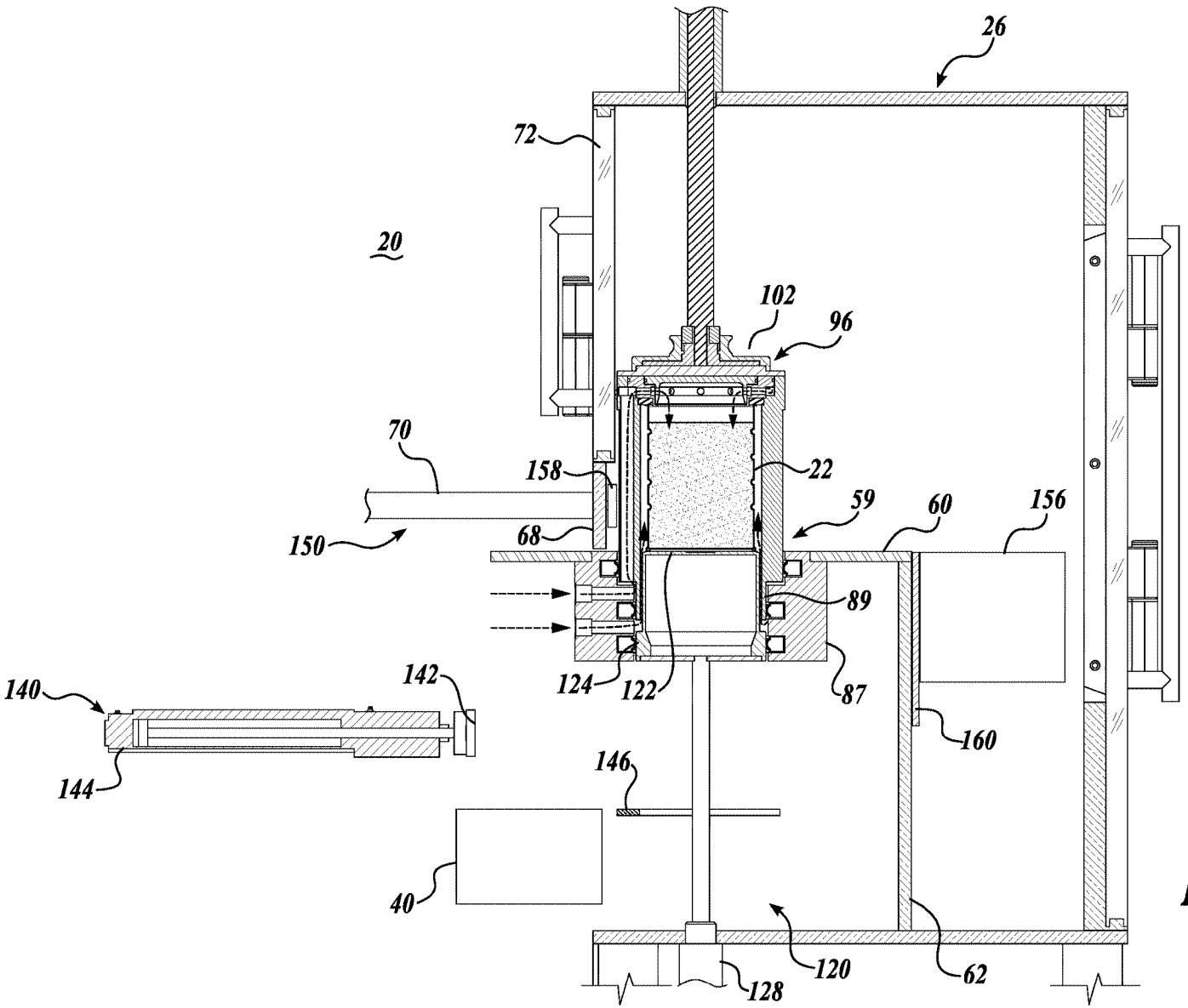
Figure 7E:
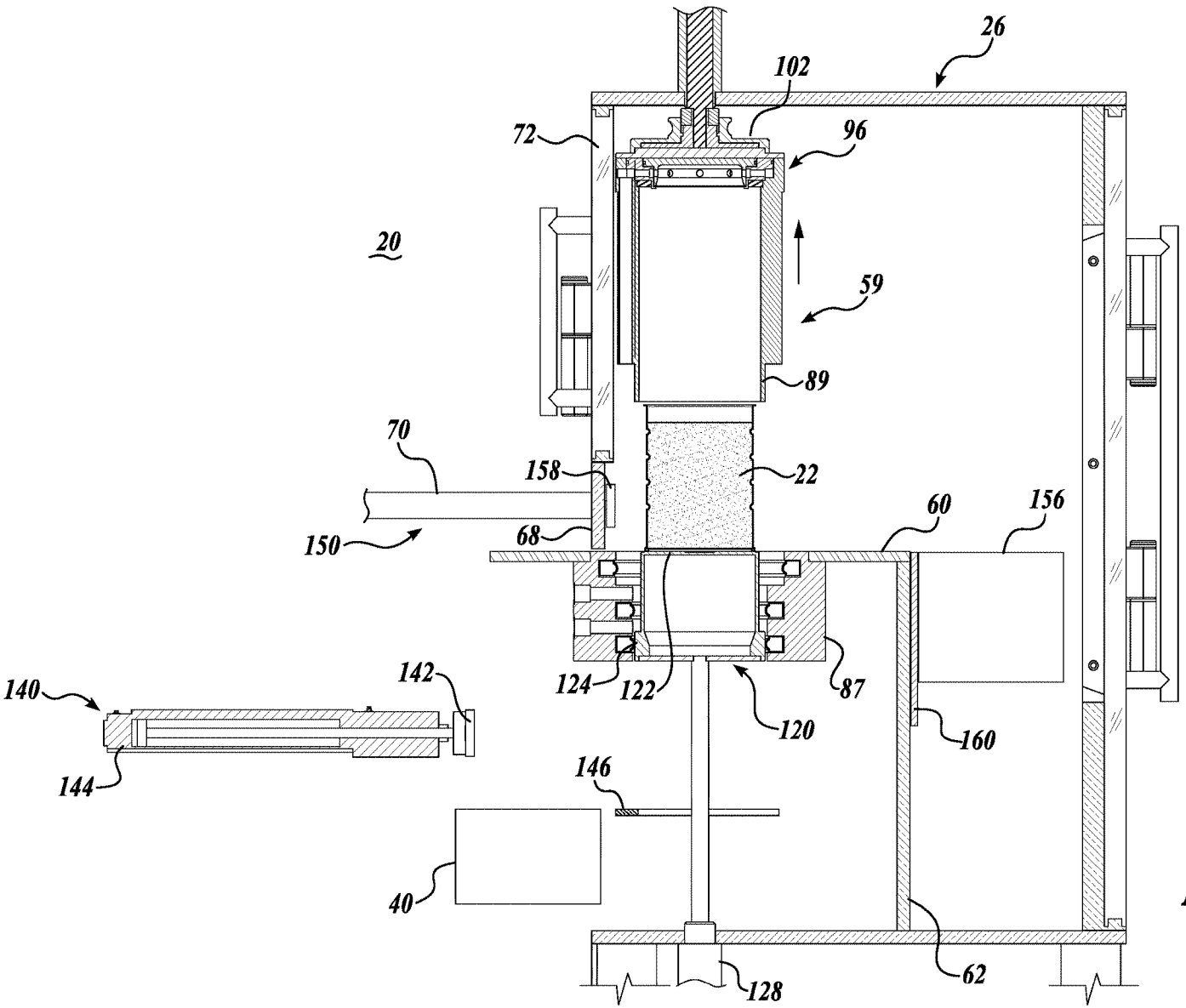
Figure 8A:
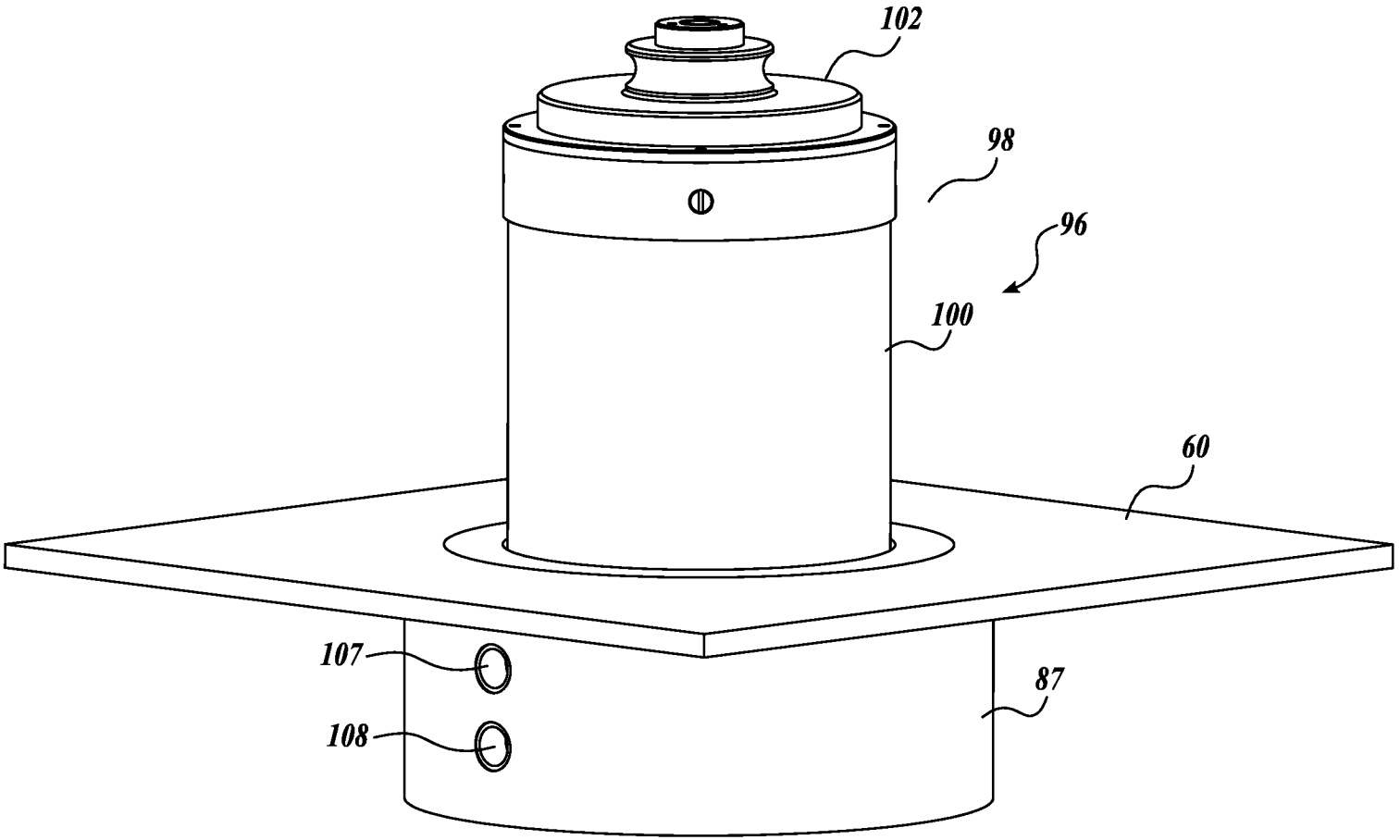
FIG. 8A is an enlarged fragmentary cross-sectional view of FIG. 1 specifically illustrating the construction of a shroud and lift platform.
Figure 8B:
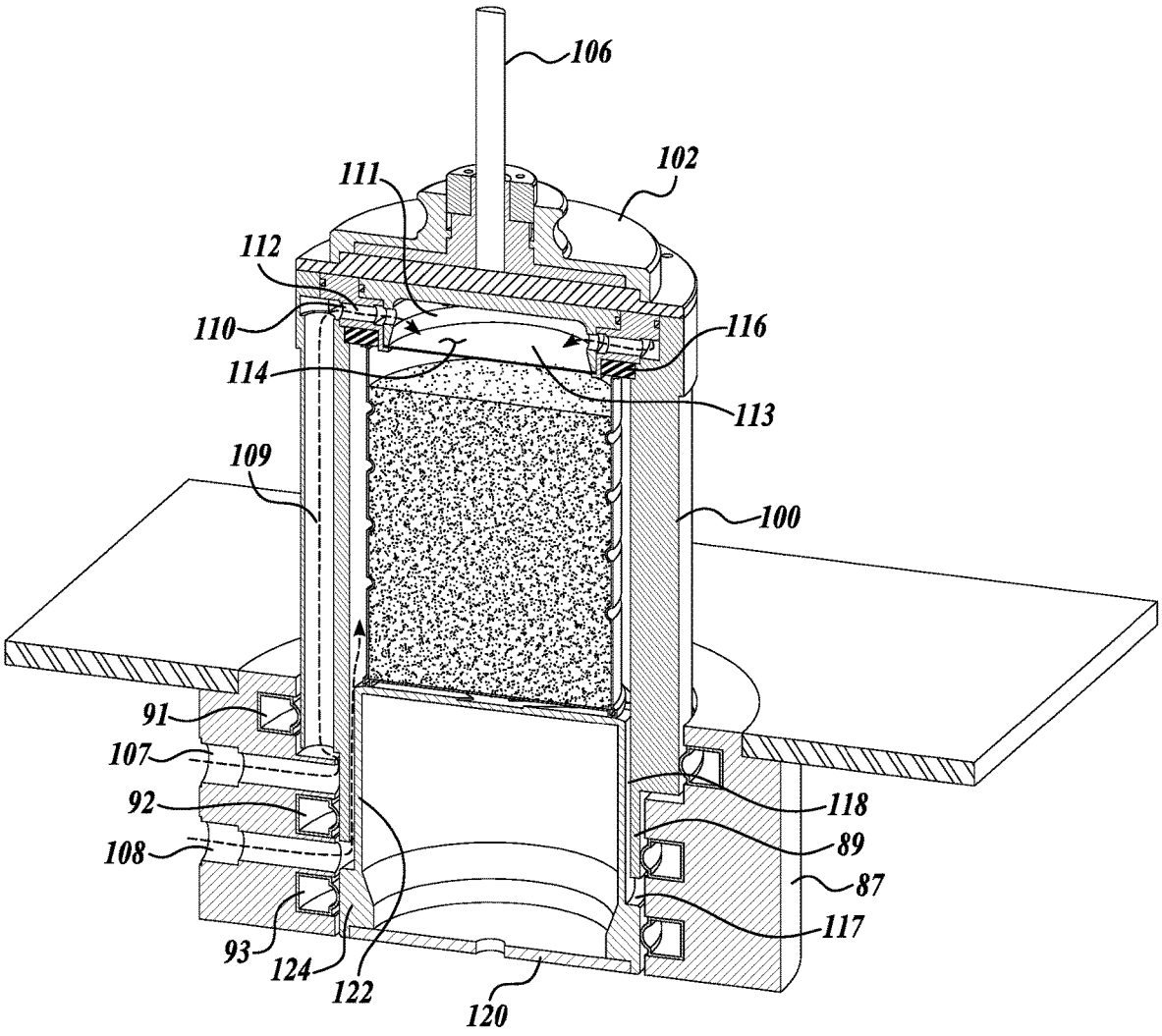
FIG. 8B is a cross-sectional view of FIG. 8A taken along lines 8B-8B thereof.
Figure 8C:
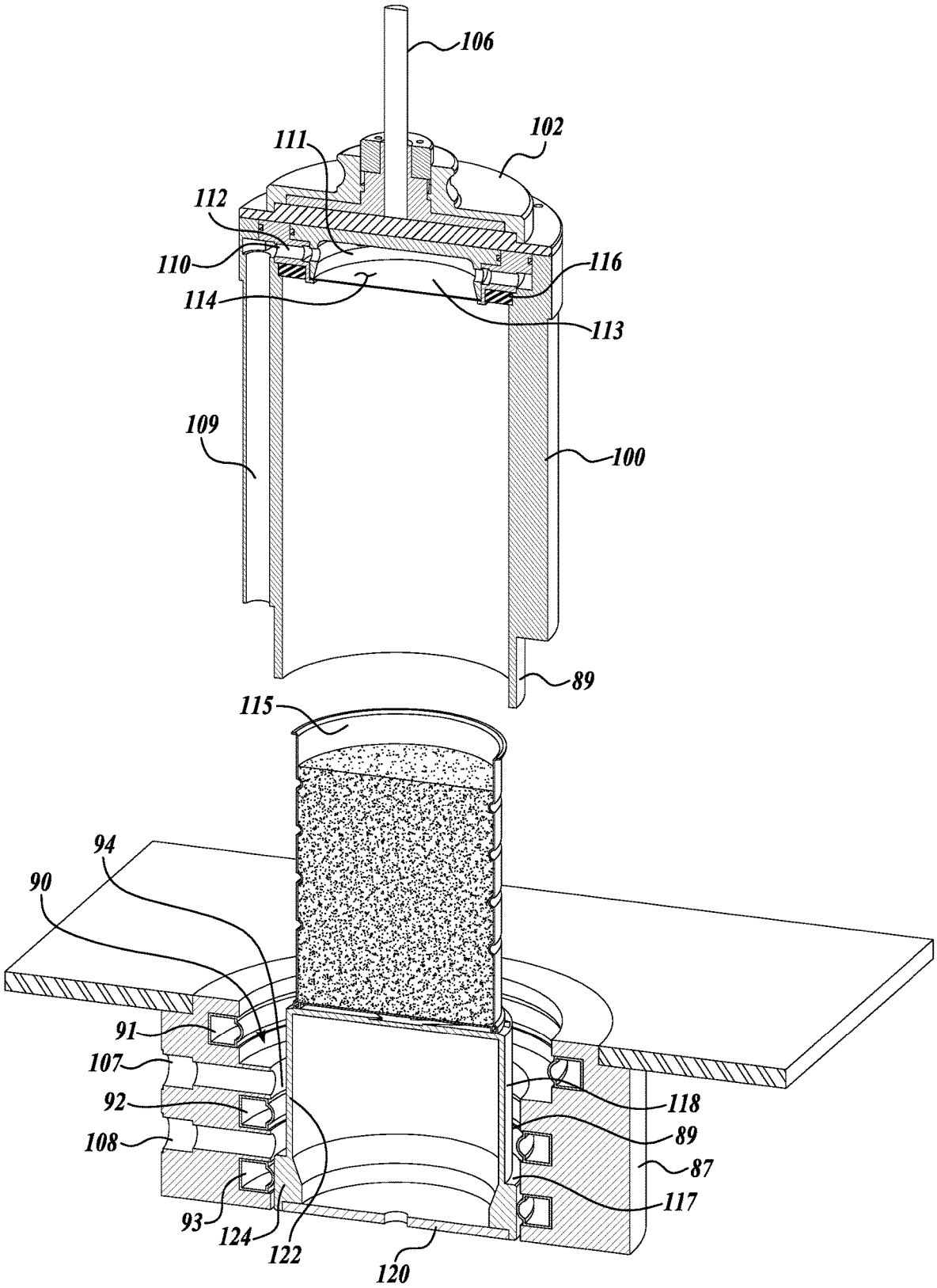
FIG. 8C is an exploded view of FIG. 8B.

It will be appreciated that when the lift platform 120 is in the fully extended upward position and the shroud 98 is in fully downward extended position, the interior of the shroud is isolated from both the ambient and the interior of the housing, as shown in FIGS. 7C, and 8B. As described below, during this condition, the ambient air within the shroud and container 22 is removed and replaced with an inert gas or gas mixture at a pressure above atmospheric pressure.

When the shroud 98 is in lowered closed position and the lift table 120 is in extended upper position, as shown in FIG. 8B, both the interior of the container 22 positioned within the shroud and also the volume between the exterior of the container and the interior of the shroud are evacuated and replaced with the modified atmosphere of, for example, an inert gas or gas mixture through upper and lower ports 107 and 108 that extend horizontally radially inwardly from the exterior diameter of the ring seal 87. The upper shroud port 107 intersects with the bottom of a vertical passageway 109 extending upwardly through the shroud upper sidewall section 100 to intersect with a horizontal annular groove 110 formed in the outer circumference of a manifold ring 111. Radial holes 112 extend inwardly from the horizontal annular groove 110 to communicate with the open central interior 113 of the manifold ring 111. Such open central interior 113 is in communication with the open top and thus the head space 115 of the filled container 22.

Referring specifically to FIG. 8B, a porous barrier 114 is mounted to the underside of the manifold ring 111 inside of an annular seal 116 extending along the underside manifold ring 111. As will be appreciated, the annular seal 116 serves to also seal the top rim of the container relative to the manifold ring 111. The perimeter of the porous barrier also seals relative to the manifold ring and the sealing ring 116. As such, the head space 115 of the container 22 is isolated from the exterior of the container. The barrier 114 allows air/oxygen to be drawn out of the container while substantially preventing the powder or other content within the container from escaping from the container as the container is being evacuated. The porous barrier may be composed of fabric, woven material, perforated sheet material, or other appropriate material.

Continuing to refer specifically to FIGS. 6, 7A-7H, and 8B, the volume or space between the exterior of the container 22 and the interior of the shroud 98 is separately but simultaneously evacuated and then replaced with modified atmosphere from the evacuation of the interior of the container. The reason for this separated evacuation and modified air replacement system is to prevent powder or other contents of the container 22 from flowing from the container interior through barrier 114 during evacuation of the container and thereby contaminating the can outer surface or face with the powder or other content. Also, the vacuum and replacement gassing cycles are applied to the can head space 115 and to the can exterior at the same time thereby to avoid the can from imploding or otherwise being damaged during the vacuum cycle, especially cans with an exterior foil wrapping. In this regard, the shroud lower port 108 is in communication with an annular cavity 117 located just above the shoulder section 124 of the lift table. The cavity 117 is in fluid flow communication with an upwardly extending narrow gap 118 between the exterior of the lift table upper section 122 and the interior of the shroud upper wall section 110 as well as the shroud pilot section 89.

Although the foregoing provides one example in which the interior and exterior of the container 22 may be separately but simultaneously evacuated and gassed, it is to be understood that other systems for carrying out this function may also be employed. For example, systems that evacuate and introduce replacement gas through the closed top assembly 102 of the shroud.

Also, the upper intermediate and lower seals 91, 92 and 93 can be of various construction. For example, the seals can be composed of inflatable air seals which can be inflated to achieve secure and tight seals against the shroud and lift table and also deflated to permit the shroud and lift table to be both engaged and disengaged from the sealing ring 87 without any significant resistance against the seals. Of course, other types of seals may be employed, for example O-ring seals, V-seals, double or even triple V-seals, etc.

The containers 22 that are delivered to the housing 26 by infeed conveyor 40 are moved laterally off the infeed conveyor and onto the lift platforms 120 by a lateral pusher system 140, as shown in FIGS. 1, 5, 6, and 7A-7H. The pusher system 140 includes a horizontal push bar 142 for pushing against the sides of the cans 22 to remove the cans from the conveyor 40 and onto an associated base 122 of lift platform 120. The push bar 142 may be contoured along its leading edge 143 adjacent the containers 22 so that the containers are indexed into correctly spaced positions along the conveyor 40. If the cans 22 are not accurately spaced along the conveyor 40 to match the positions of the lift platforms 120 and corresponding seal ring/housing openings 94, the pressing or urging of the contoured leading edge 143 of push bar 142 against the sides of the filled containers will reposition the containers relative to each other so that they are in proper registry with the positions of the lift platforms 120 and housing openings 94.

Figure 6:
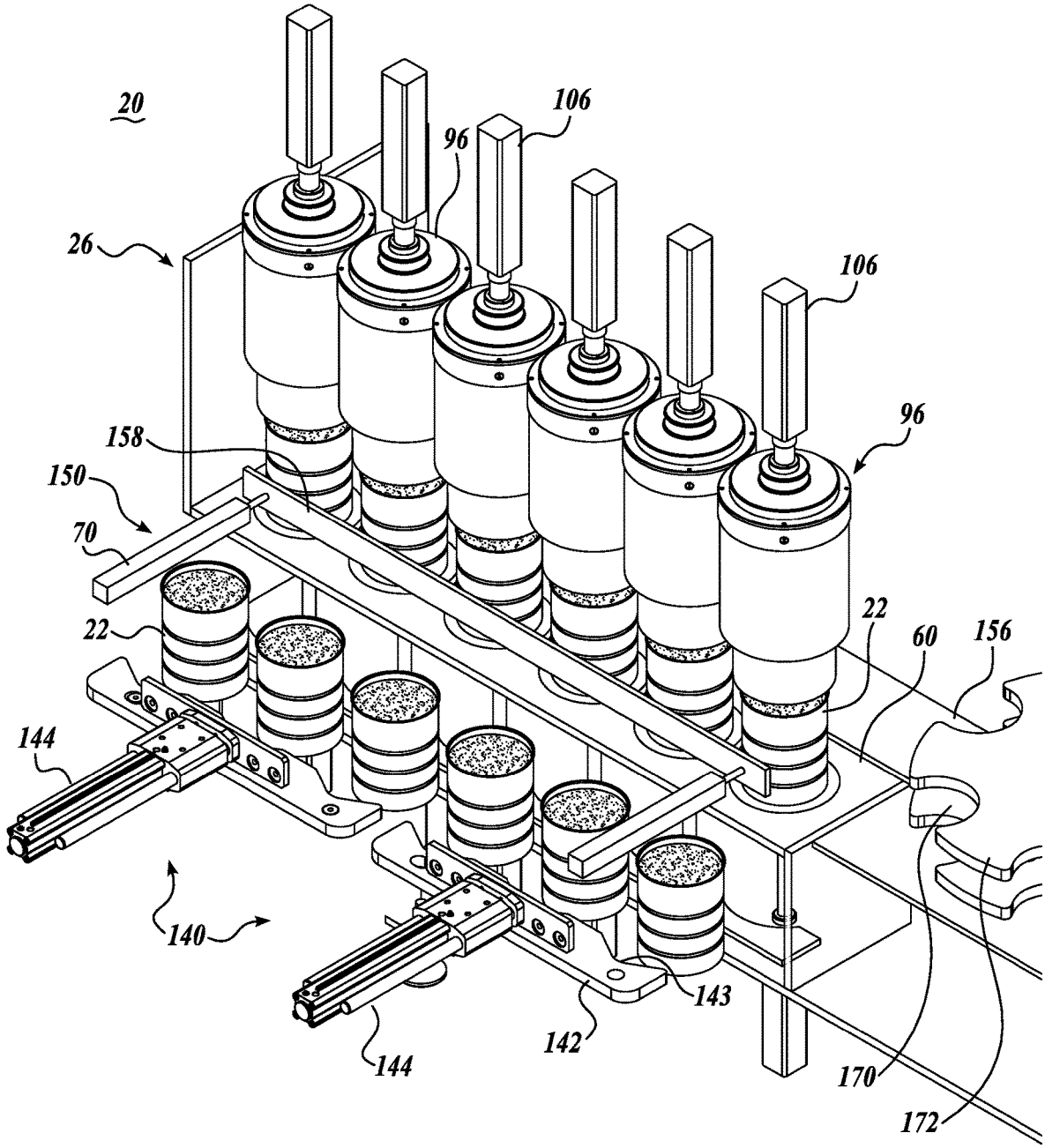
FIG. 6 is an enlarged fragmentary pictorial view of FIG. 5.

A linear actuator 144 is provided to support and actuate the push bar 142 to push the cans from the conveyor 40 and onto the lift platform 120. As shown in FIG. 7A, a bridging ramp 146 is provided so that there is continuous surface between the conveyor 40 and the lift platform base 122 along which the containers 22 may be slid when pushed by the push bar 142. Although two separate pusher systems 140 are shown in FIG. 6, one for each set of three containers 22, a single pusher system 140 may be utilized or more than two pusher systems may be utilized.

Continuing to refer specifically to FIGS. 1, 5, 6, and 7A-7H, a second pusher system 150 is provided at an elevation above the pusher system 140. This second pusher system includes actuators 70 that function to push the cans 22 laterally after the shroud 98 has been retracted upwardly once the container 22 has been evacuated and the removed ambient air replaced with an inert gas or gas mixture, see FIG. 7F. At this point, the containers are pushed by the pusher system 150 onto a seamer infeed conveyor 156. during for transport to the closure/seaming station 28. To this end, the pusher system 150 includes a horizontal pusher bar 158 that is actuated by horizontal actuators 70 mounted to extend laterally outwardly from housing 26. The actuators 70 are sealed with respect to the housing to maintain the atmospheric conditions within the housing. As noted above, such atmospheric conditions include a low level of residual oxygen in a gas mixed environment and an over-pressure of, for example, about 20 mbar gauge.

After the actuators 70 push the containers 22 from the lift platforms 120 and onto the seamer infeed conveyor 156, a container guide bar 160 is simultaneously raised along the conveyor 156 next to the baseplate 60 to restrain the containers in the lateral direction relative to the direction of travel of the conveyor 156. See FIG. 7G. The guide bar is located between the side of the conveyor 156 and the baseplate 60 as shown in FIGS. 7A-7H. The guide bar is raised and lowered between conveyor 156 and the baseplate 60. The guide bar 160 is in the lowered position allowing for the container to be transferred from the lift platform 120 on to the seamer infeed conveyor 156, see FIG. 7F. Following the transfer of the container the guide bar is raised creating a guide for the container to transfer along the conveyor without risk of the container being dislodged, see FIG. 7G.

Figure 5:
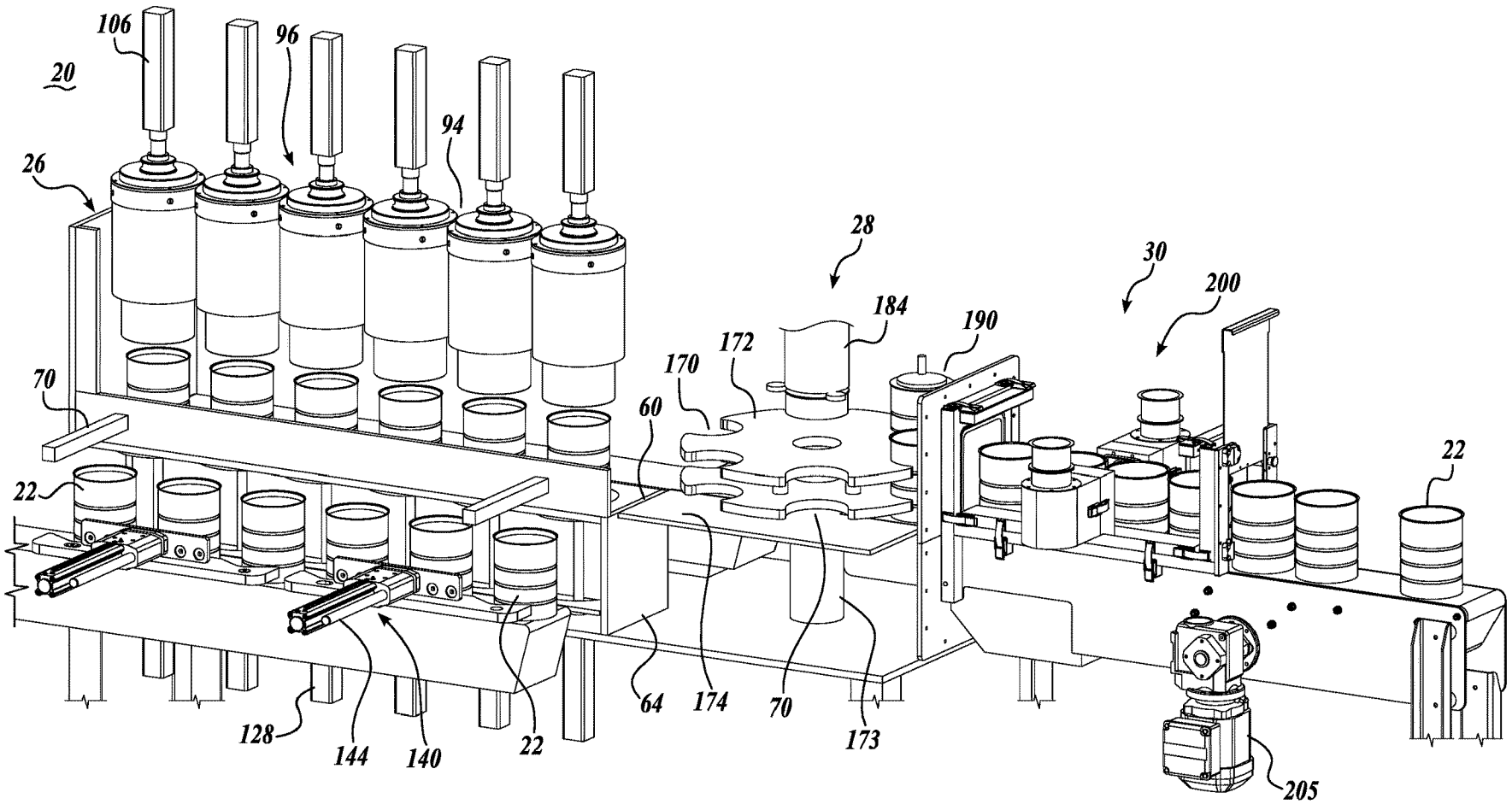
FIG. 5 is a fragmentary view of portions of the interior of the evacuation housing.

The seamer infeed conveyor 156 transports the containers 22 to a closure/sealing/seamer station 28 which perhaps is most clearly shown in FIG. 5. As with the conveyor 136, the seamer station 28 is also within the sealed chamber 26 wherein the chamber includes a modified atmosphere environment to maintain the low residual oxygen level achieved in the container following the extraction of the Oxygen and replenished with gas injection. To this end, the containers 22 are fed into circumferential, outwardly open pockets 170 formed along the circumference of a rotatable double star wheel 172 that is mounted on a central rotatable shaft 173. A floor 174 is provided for supporting the containers 22 when inserted within the pockets 170. The containers are secured in the star wheel pockets by a guide rail or other means with a clearance of approximately 2 mm between the guide rail and the depth of the star wheel pocket. This clearance allows for a degree of flexibility to accommodate the potential variance in the tolerance of the container dimensions.

The double star wheel 172 is indexed from a first position/station in registry with the seamer infeed conveyor to a second position/station in registry with a stack magazine 180 filled with covers 182, which are placed onto the open top of the containers at the magazine station. Next, the double star wheel 172 is indexed to a seaming station 190 wherein a cover 182 is seamed to the upper edge of the container 22 in a standard manner Such seamers are articles of commerce.

The above process of placing the covers 182 on the containers 22 and then seaming the containers can occur one at a time as each can is shifted from the seamer infeed conveyor to the double star wheel. Alternatively, all of the containers 22 can be loaded on the double star wheel at the same time so as to fill the pockets of the double star wheel and then the covers 182 applied to the filled star wheel cans and thereafter the covers are seamed with the containers 22. In this manner, the seamer infeed conveyor 156 is emptied quickly so that a second set of evacuated containers 22 can be loaded onto the seamer infeed conveyor.

The outer circumference of the covers 182 snugly slides against the inside surface of the lower collar portion 184 of the magazine 180. In this manner, the covers acting against the collar 184 provide a seal between the interior of the housing 26 and the ambient. To this end, it is desirable that a sufficient number of covers 182 are positioned within the magazine 180 so as to maintain a seal with the collar portion 184.

As noted above, the sealed containers 22 are removed from the housing 26 while maintaining the atmosphere within the housing. To this end, as perhaps most clearly shown in FIGS. 1-5, removal system 30 includes an airlock structure 200 having an elongated housing 202 positioned over an outfeed conveyor 204 powered by an actuator 205. The airlock structure 200 includes sealable doors 206 and 208 at the opposite end of the housing 202 for the purpose of allowing entry of the sealed cans into the airlock structure, and then out of the structure via the outfeed container 204. While the airlock structure 202 is empty, the pressure within the airlock may be reduced to match the pressure within the structure 202 and the ambient air within the structure 202 may be replaced with the same inert gas or gas mixture utilized within the housing 26 so that when the near door 206 is open, the atmosphere within the structure 202 matches the atmosphere within the interior of the housing 26. Thereupon a set of sealed cans may be advanced into the airlock structure 202 and then the near door 206 closed to seal the housing 26 from the airlock structure 202. Therefore, the far door 208 of the airlock structure may be opened and then the sealed cans removed from the airlock structure by operation of the outfeed conveyor 204.

Figure 9:
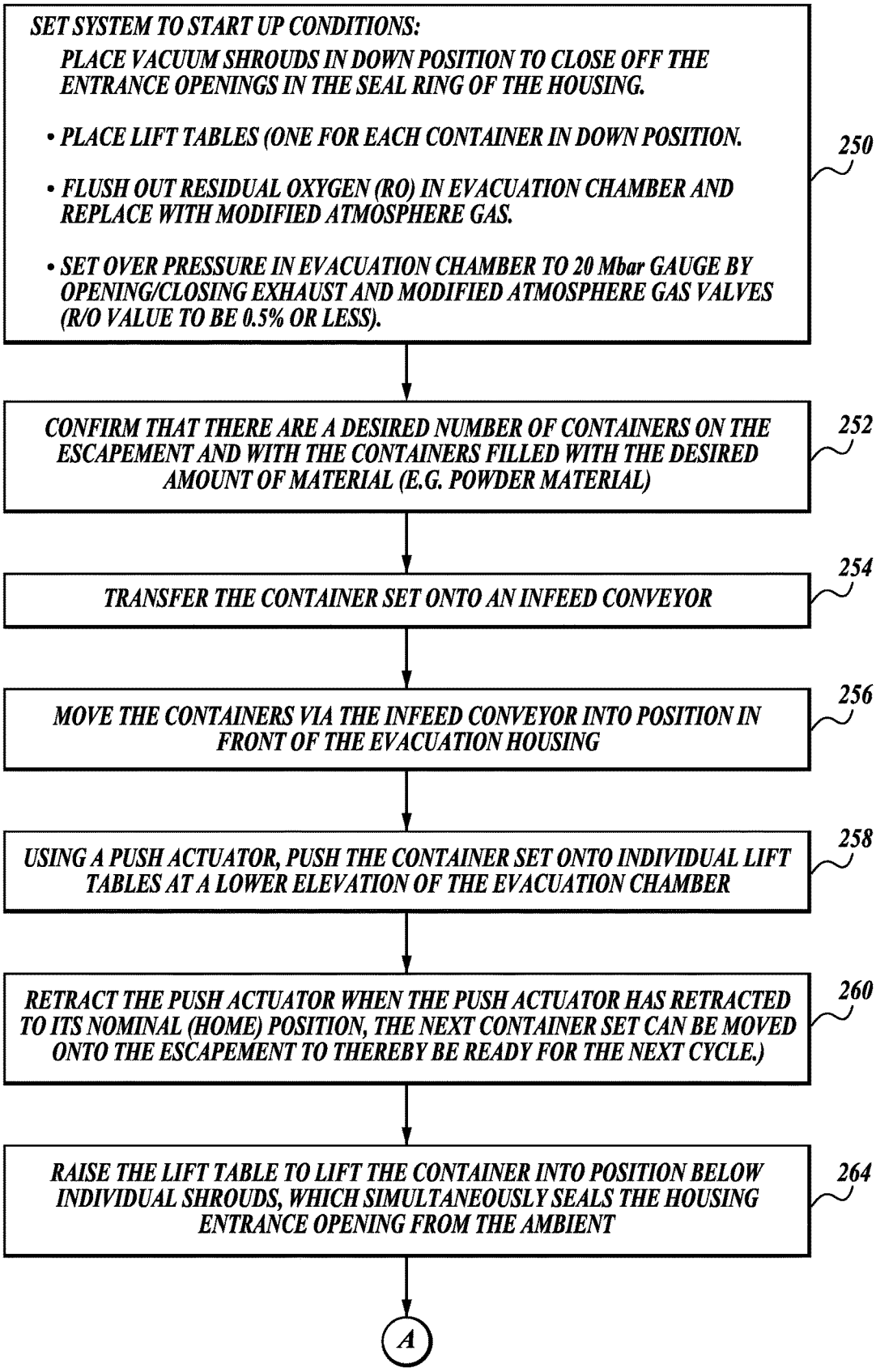
FIG. 9 is a flow diagram illustrating one method of utilizing the system of the present disclosure.
Figure 9:
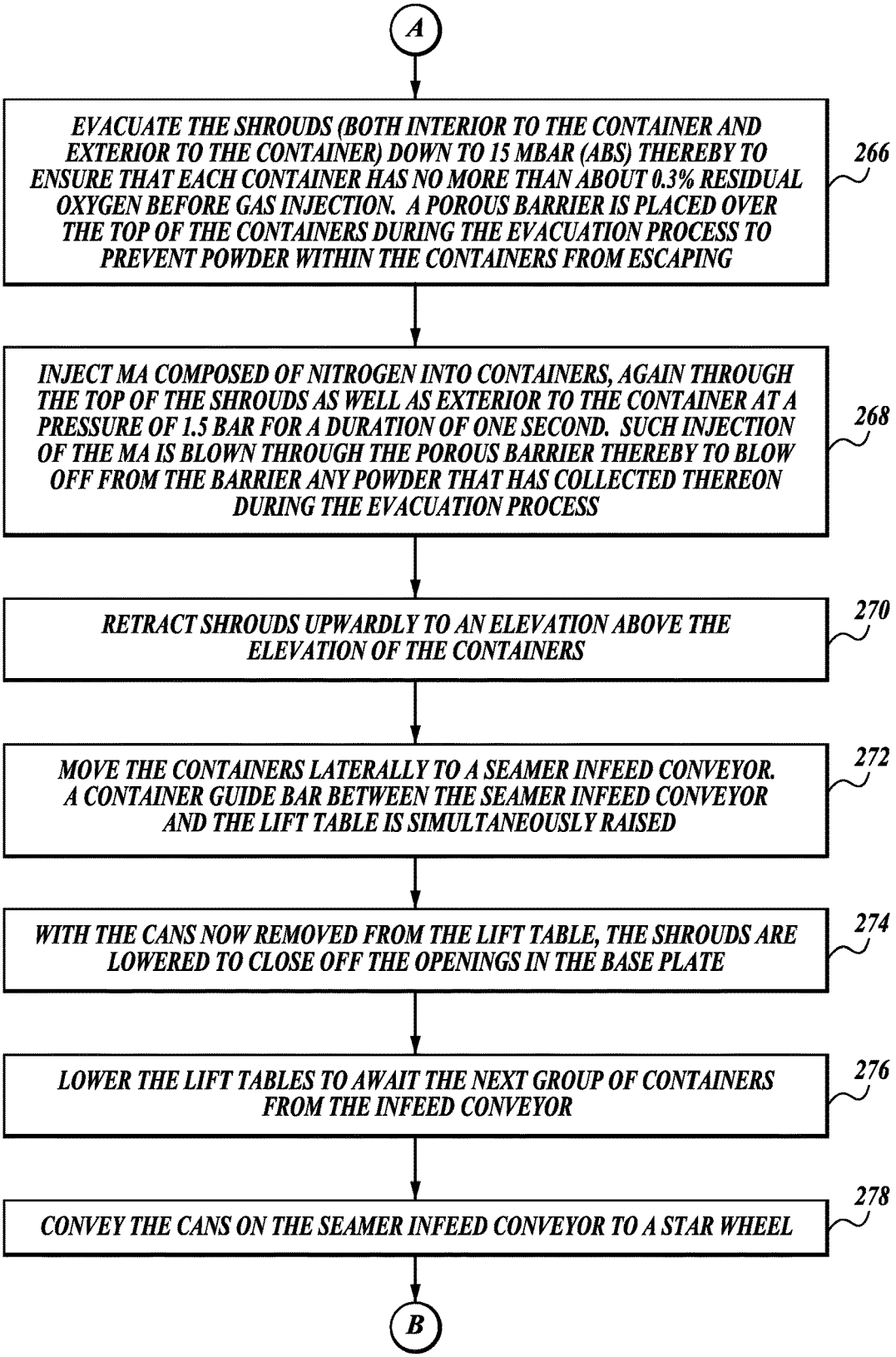
Figure 9:
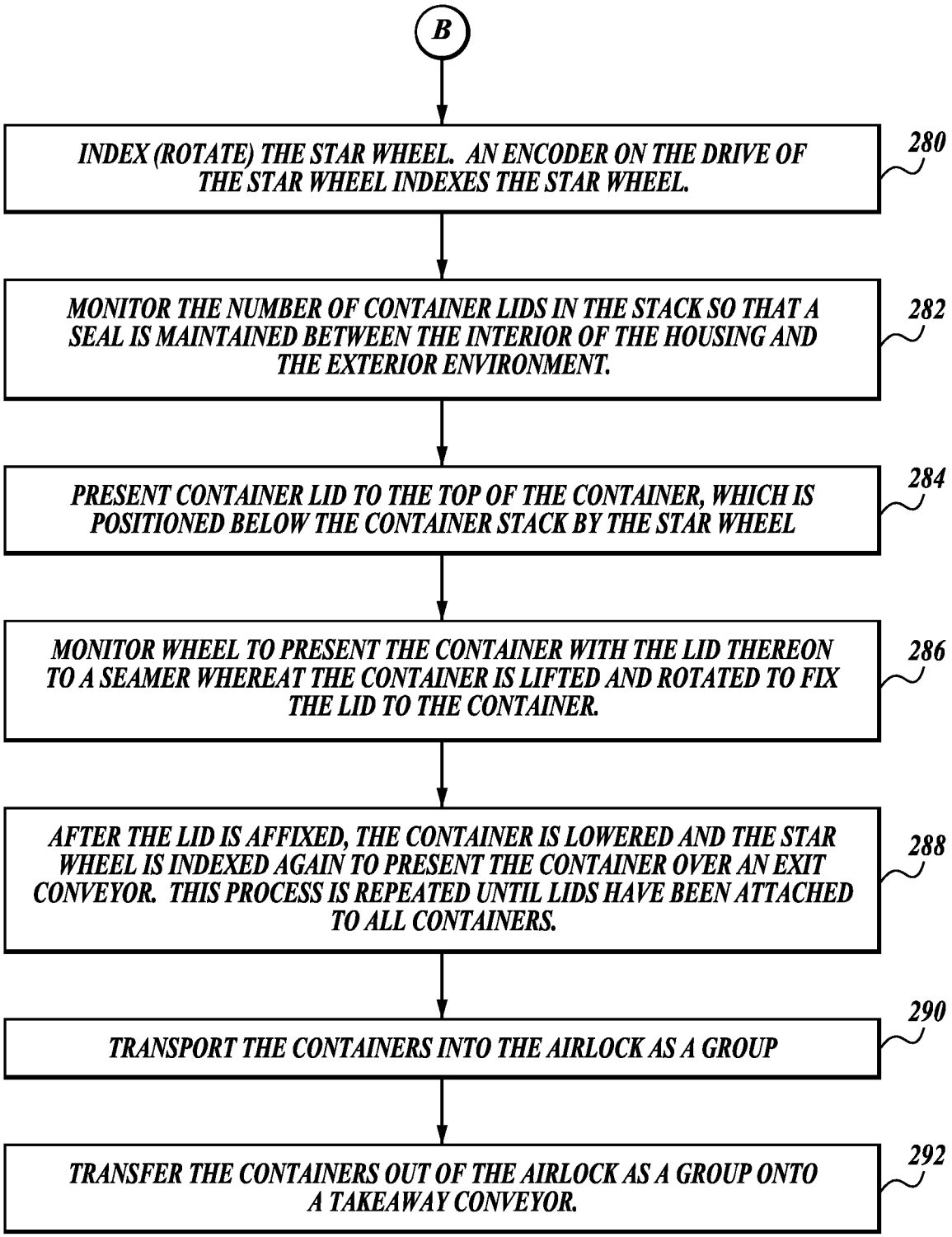

FIGS. 7A-7H together with FIG. 9 illustrate one example of the use of the present system 20 for replacing the air in containers 22 with modified or inert gas or gas mixture and then sealing the container 22. Under such conditions, the content within the container 22 can be maintained in a preserved state for a prolonged period of time, especially if the content consists of food. Substantially all of the oxygen has been removed from the container which minimizes degradation of the container content.

The method begins at step 250 wherein the system 20 is set to start-up conditions or parameters. In this regard, the vacuum shrouds 98 are in lowered position to close off the entrance openings 94 in the seal ring 87 of the housing 26 via upper end intermediate seals 91 and 92. See FIG. 7A. The lift platforms or tables 120 are in down position for reception of the filled containers 22 from the filling station. Any residual oxygen in the housing 26 is flushed out and replaced with a modified atmosphere composed of, for example, nitrogen, carbon dioxide or a mixture thereof. The pressure within the housing may be set to approximately 20 mbar gauge, which is achieved by opening and closing the exhaust and modified atmosphere gas valves. Of course, the over-pressure within the housing 26 can be at other levels either above or below 20 mbar gauge. The residual oxygen level in the housing is reduced to a range of about 2.5% to 0.5% by volume or less. In one non-limiting example, the residual oxygen level may be about 1.5% by volume.

After the foregoing startup conditions are met, in step 252, in the operation of system 20, the system confirms that there are a desired number of containers 22 at the escapement from the filling station and that the containers are filled with the desired amount of material, e.g., powder material.

Figure 3:
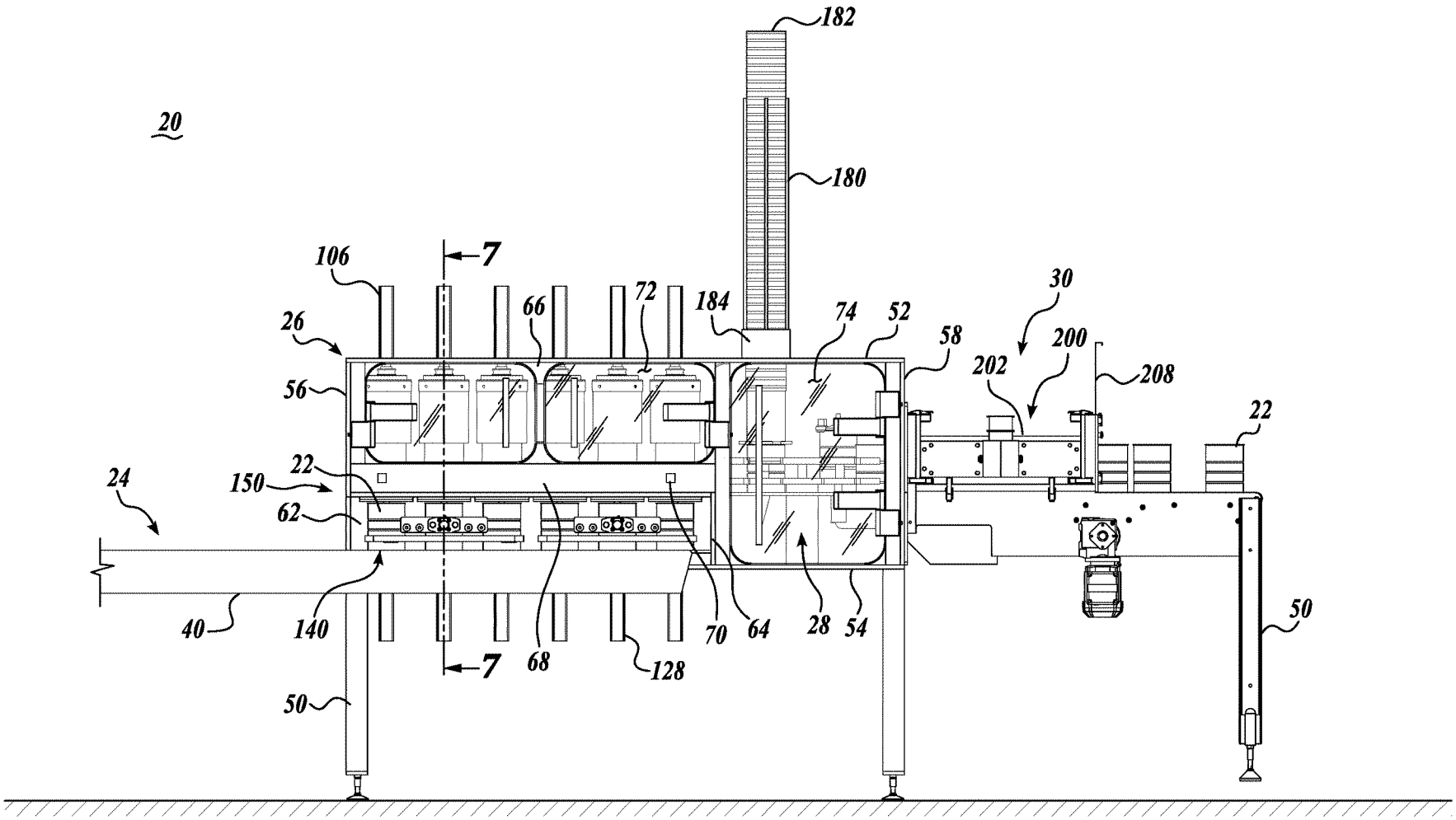
FIG. 3 is a side elevational view of FIG. 1.

Next, in step 254, the filled containers 22 are transferred onto an infeed conveyor 40 and then in step 256 the containers are transported by the infeed conveyor to a position in front of the evacuation housing 26 at a lower elevation of the housing, for example, as shown in FIGS. 1 and 3.

Next, in step 258, the pusher system 40 is used to push the containers of the set onto individual lift tables or platforms 120, see FIGS. 7A and 7B. The lift tables 120, which are in lowered position below the mezzanine 59 of the housing. In step 260, the actuators 144 of the pusher system 140 are retracted to their nominal (home) position so that the next set of containers 22 can be moved onto the escapement to be ready for the next cycle.

Next, at step 264, as shown in FIG. 7C, the lift platforms 120 are raised to lift the containers 22 into position within a corresponding shroud 98. The lift platforms simultaneously seal against the bottom or lower seal 93 of the base seal ring 87 to close off the entrance openings 94 from the ambient.

Next, at step 266, the pressure within the container 22 is evacuated through port 107 down to approximately 15 mbar (ABS) thereby to help ensure that each container has no more than about 2.5% to 0.5% residual oxygen by volume therein once the inert replacement gas has been injected into the shroud, also through upper port 107. The porous barrier 114 disposed over the open top of the container 22 during the evacuation process prevents powder or other material within the container from escaping. See FIG. 7D. At the same time, the pressure between the exterior of the container and the interior of the shroud is also simultaneously evacuated to the same pressure level as within the container via lower port 108. As a non-limiting example, the evacuation of the container 22 as well as the evacuation of the volume between the exterior of the container and the interior of the shroud can be accomplished in about 5 seconds; however, this process can be carried out over a shorter or longer period of time.

Next, at step 268, a modified atmosphere composed of, for example, nitrogen, carbon dioxide, or a mixture of both is injected into the container through upper port 107. Such injection of the modified atmosphere is blown through the porous barrier 114 thereby to blow off from the barrier any material or powder that has collected thereon during the evacuation process. See FIG. 7D. Simultaneously, the same modified atmosphere is injected through port 108 to fill the volume between the exterior of the container 22 and the interior of the shroud 98. As a non-limiting example, the modified atmosphere can be injected into the container 22 as well as into the volume between the exterior of the container and the interior of the shroud at a pressure of about 1.5 bar for a time period of about 1 second. This process can be carried out at other pressures and for other time durations.

At this stage, the oxygen level within the container and shroud and the pressure within the container and shroud could match the atmospheric conditions within the housing itself. However, it may be desirable if the pressure within the container and within the shroud were either higher or lower than the pressure within the housing. For example, if the pressure within the container 22 and shroud 98 is higher than that within the housing, this can help maintain the low residual oxygen level within the container.

Next, at step 270, the shroud 98 is retracted upwardly to an elevation above the containers (see FIG. 7E), thereby exposing the container 22 to the atmosphere within the housing.

Figure 7F:
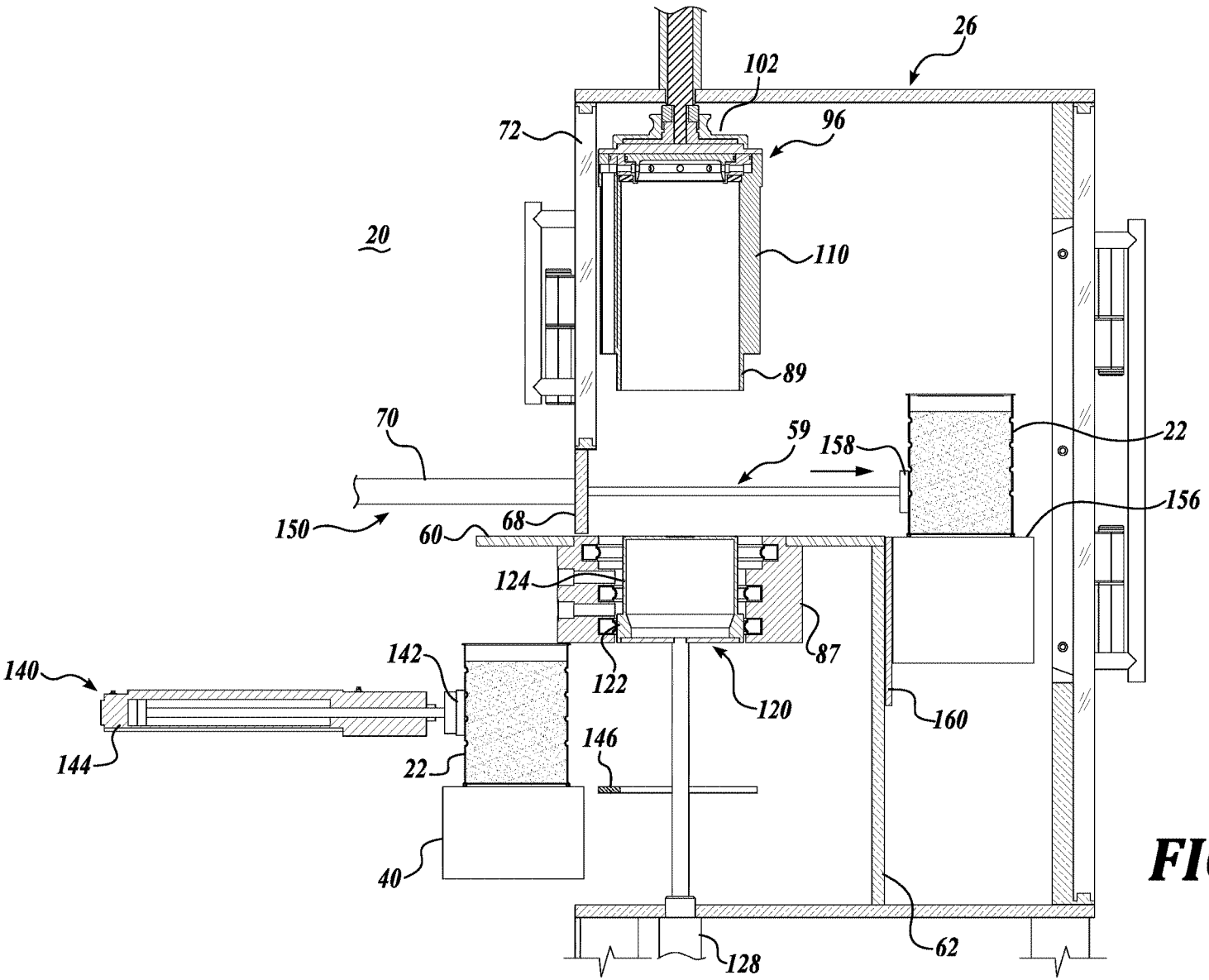
Figure 7G:
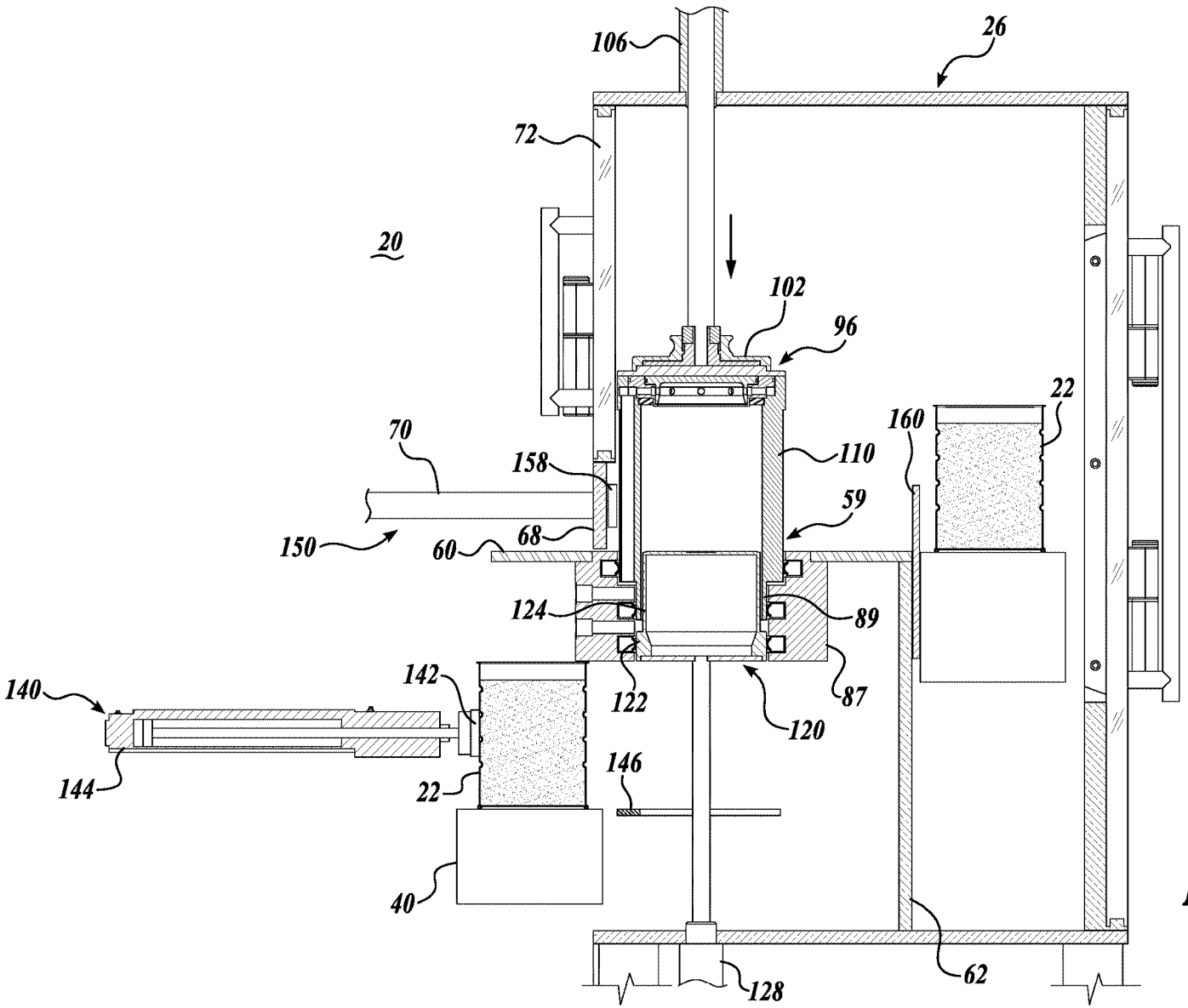
Figure 7H:
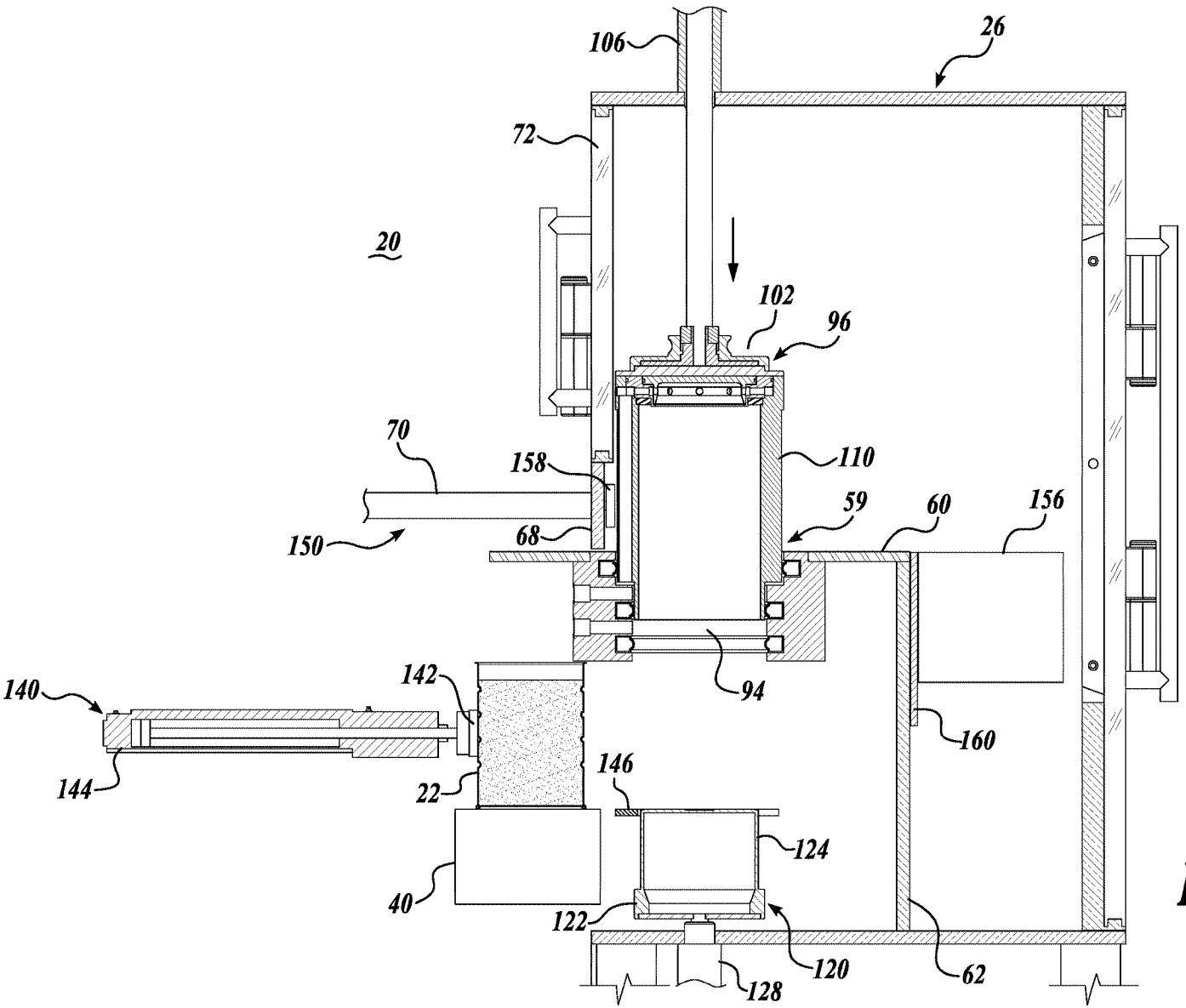

Then at step 272, the containers 22 are moved laterally by upper pusher system 150 to a seamer infeed conveyor 156, as shown in FIG. 7F. With the containers now removed from the lift platform 120 at step 274, the shrouds 98 are lowered to close off the openings 94 in the base plate 160, see FIG. 7G. Next, at step 276, the platforms 120 are lowered, as shown in FIG. 7H, to await the next group of containers 22 from the infeed conveyor 40.

Thereafter, as set forth in step 278, the filled cans 22 are conveyed by the seamer infeed conveyor 156 to engage within a pocket 170 of star wheel 172. Next, at step 280, the star wheel is indexed (rotated) by the use of an encoder positioned on the drive shaft 173 of the star wheel. Simultaneously, at step 282 the number of can lids 182 in the magazine (stack) 180 is monitored to ensure that a seal is maintained between the interior of the housing and the external environment, which seal is created by the stack of container lids 182 in the base portion 184 of magazine, step 282.

At step 284, a container lid 182 is placed on the open top of each of the containers 22 when the container is positioned below the lid magazine 180. At step 286, the double star wheel 172 is indexed to present the container 22 with the lid/cover 182 thereon to a seamer station whereat the container is lifted and rotated to affix the lid 182 to the container 22 in a standard manner.

At step 288, after the lid 182 is affixed, the container 22 is lowered and the star wheel 172 is indexed again to present the sealed container onto an exit conveyor 204. This process is repeated until all of the covers/lids 182 have been attached to the containers.

Next, at step 290, the sealed containers as a group are transported into the airlock 200. After the airlock 200 has been sealed from the housing, at step 292, the containers are transferred out of the airlock as a group onto the exit conveyor 204.

The foregoing represents merely one example of a method of utilizing the system 20 of the present disclosure. It is possible that some of the foregoing steps might be combined or eliminated or modified or replaced with a different step while still resulting in an efficient method for evacuating and sealing containers 22, especially containers filled with powdered material.

While illustrative embodiments have been illustrated and described, it will be appreciated that various changes can be made therein without departing from the spirit and scope of the invention.

For example, although the present disclosure describes processing a plurality of containers in sets of six at a time, a lesser or greater number of containers may be processed as a batch. For example, 4, 5, 7, 8, 9, or 10 containers could be processed as a batch.

As a further alternative, although a separate lift platform 120 is described and illustrated for each container 22, a plurality of containers may be positioned on a singular lift platform and the plurality of containers lifted upwardly into a shroud for each container or a shroud for multiple containers.

Further, various types of containers may be processed utilizing the system 20 of the present disclosure. Such containers may consist of metallic cans, glass jars or bottles, PET or other containers capable of sustaining a reduced pressure within the container.

Although a specific seal arrangement has been described and illustrated for sealing the shroud 98 with respect to the housing opening 94 as well as the lift platform 120 relative to the housing opening 94, other sealing arrangements can be utilized. For example, the bottom of the shroud can be sealed against the top surface of the base plate 60, and the lift platform 120 can be sealed against the underside of the base plate 60.

Further, although the airlock housing 202 is illustrated as being at the elevation of the star wheel 172, the airlock housing can be located at or near the level that the containers 22 are placed on the lift tables by the pusher system 140. In this regard, the elevation of the infeed conveyor 40 may be substantially the same as the elevation of the outfeed conveyor 204 which may be desirable in certain installations.

Also, the process of removing oxygen from the interior of the housing 26 and replacing it with modified atmosphere consisting of, for example, inert gas, can be carried out using procedures and parameters other than described above. Likewise, the evacuation of the containers 22 and the evacuation of the volume between the exterior of the containers and the interior of the shrouds 98 can be performed under process conditions other than as described above.

Figure 10:
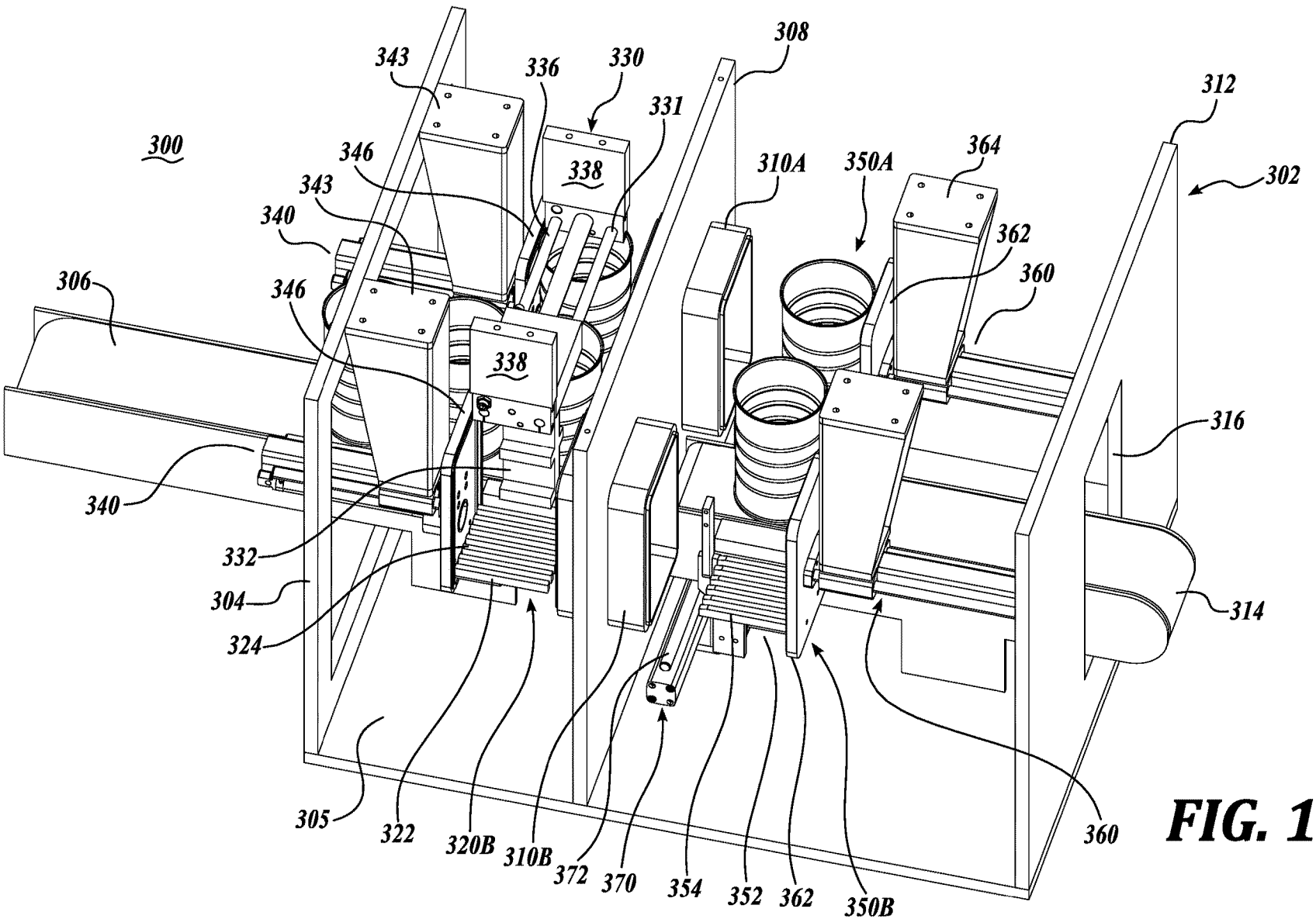
FIG. 10 is a pictorial view of a further embodiment of the present disclosure for removal of the sealed containers from the sealing station.
Figure 11:
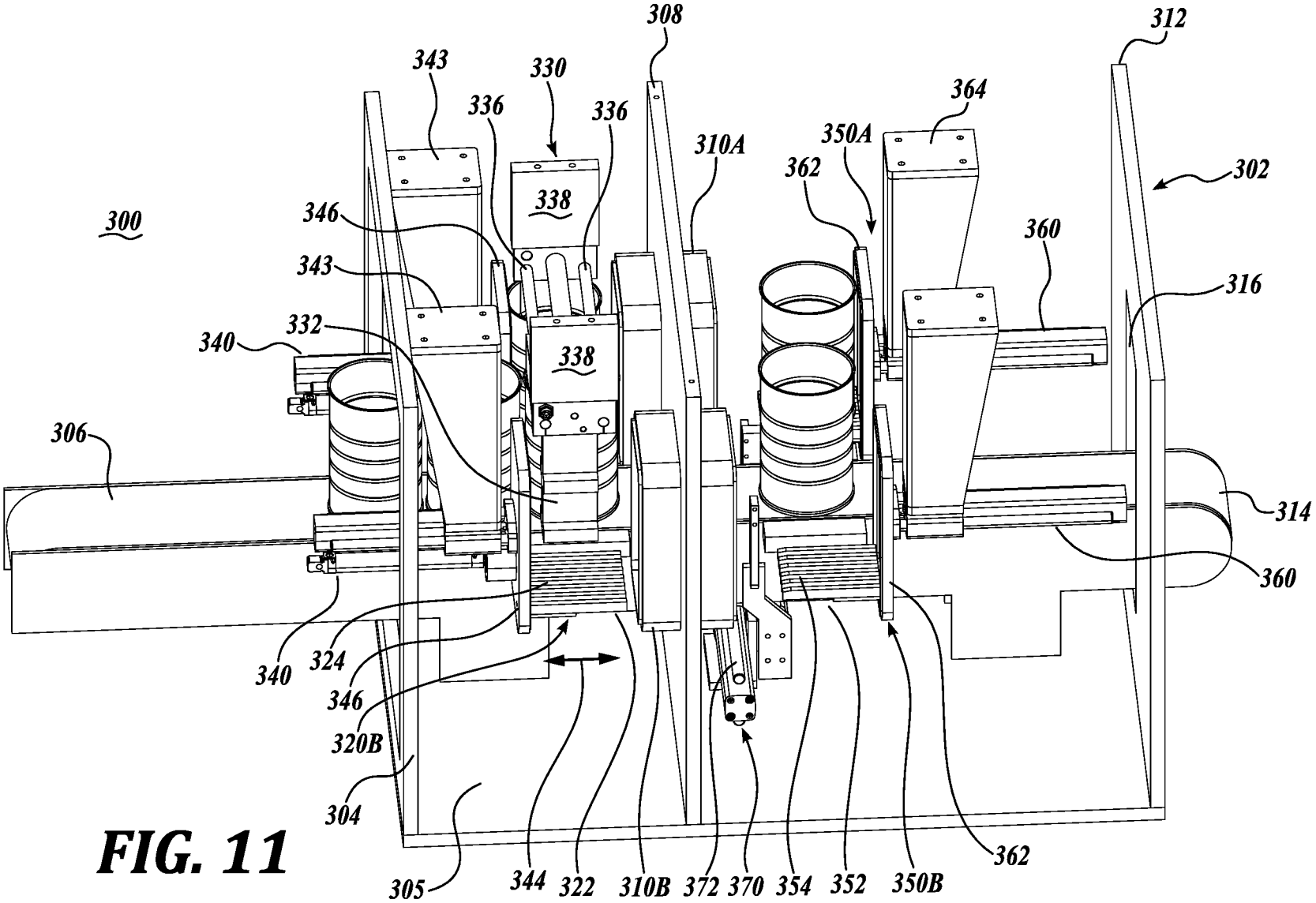
FIG. 11 is a side pictorial view of FIG. 10.
Figure 12:
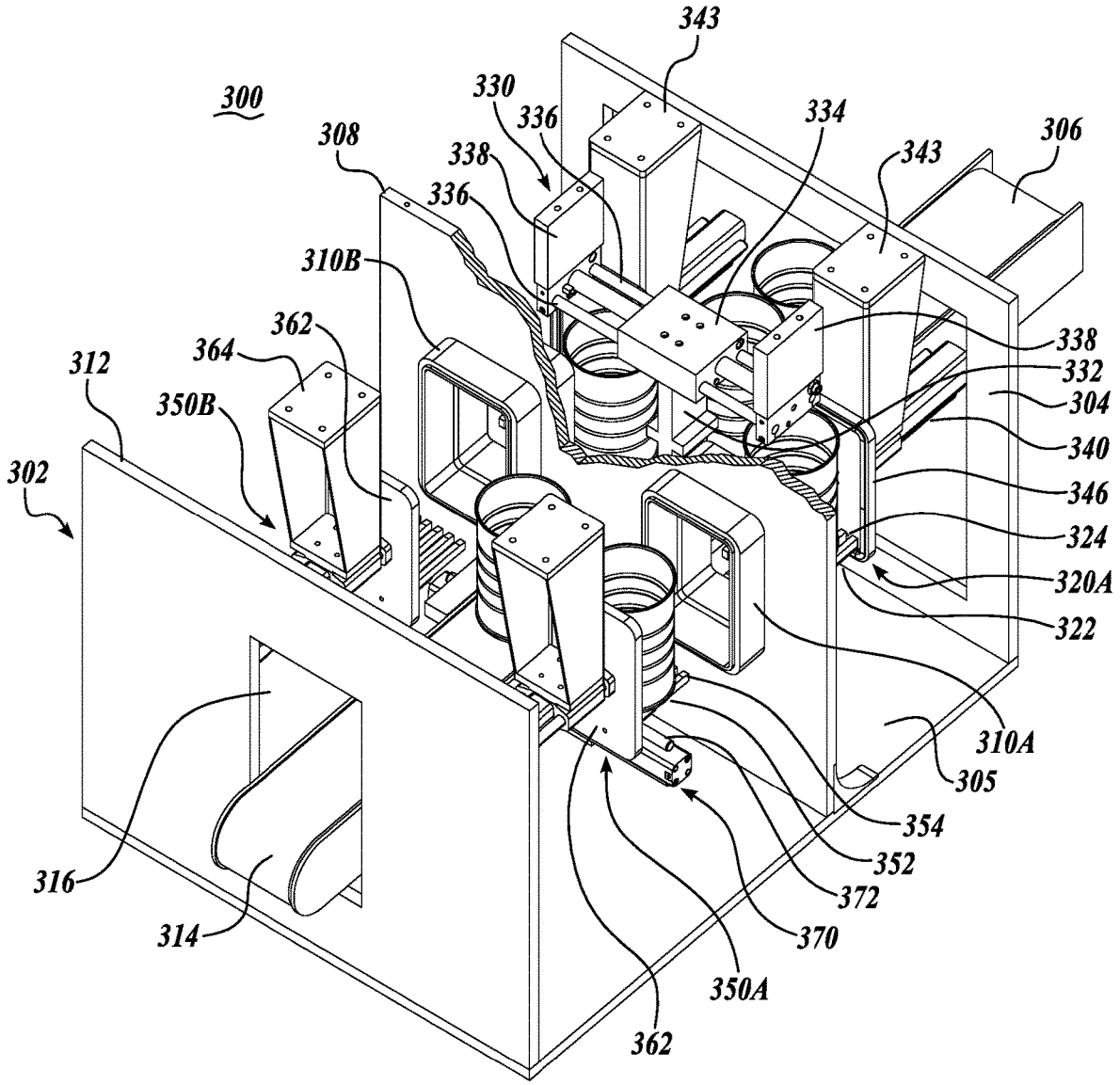
FIG. 12 is a pictorial view of the removal system of FIG. 10 shown from the opposite end of the system.

FIGS. 10, 11, 12, 13A-13G, and 14 illustrate an alternative system 300, and corresponding structure and method, for removing the sealed containers 22 from the housing 26. The system 300 may be used in lieu of system 30 described above. System 300 includes a discharge housing 302 which is shown in FIGS. 10, 11 and 12 with portions removed so that the interior components of the system can be viewed. The housing 300 does include an entrance wall 304 which extends upwardly from a floor 305 and is transverse to incoming conveyor 306. The conveyor 306 may be a separate conveyor or may be the same conveyor as conveyor 204 described above. Downstream of the entrance wall 304, the housing includes an airlock wall 308 which supports side-by-side airlock chambers 310A and 310B. An exit wall 312 is located at the end of the housing downstream of the airlock wall 308. The incoming conveyor 306 terminates at one side of the airlock wall 308 and a second takeaway conveyor 314 extends from the opposite side of the airlock wall 308 and out through the exit wall 312 through an exit opening 316. It is to be understood that the housing 302 also has side walls and a top wall. Moreover, the entrance wall 304 is integrated with the end panel 58 of the housing 26.

The space between the entrance wall 304 and airlock wall 308 defines a first transfer location where containers 22 are moved laterally off of the conveyor 306 and onto transfer structures 320A and 320B. The transfer structures include a support floor or platform 322 composed of a plurality of parallel spaced-apart bars 324 for supporting the underside containers 22. The bars 324 are cantilevered from the base of the transfer structures. The containers 22 are moved laterally from the conveyor belt 306 onto the platform 322 by a lateral actuating system 330 composed of a vertical pushing wall 332 that depends downwardly from the actuator 330 which spans between support sections 338 that depend downwardly from an overhead ceiling structure, not shown. The powered actuator 330 moves side to side between the support sections 338 whereby the pushing wall 332 pushes the containers 22 laterally from the conveyor belt 306 onto the platform portions 322 of the transfer structures 320A and 320B.

The transfer structures 320A and 320B are supported for movement in the direction parallel to the length of the conveyor 306 by an actuating system 340 which extends parallel to the conveyor 36 on each side thereof. The actuating systems are supported by column structures 343 that depend downwardly from the overhead ceiling structure (not shown). The actuating system 340 functions to move the transfer structures 320A and 320B toward and away from airlock chambers 310A and 310B, as depicted by arrow 344. The transfer structures 320A and 320B also include an airlock door 346 which seals the adjacent opening of the airlock chambers 310A and 310B when the transfer structures 320A and 320B have been advanced toward the airlock chambers whereby the doors 346 close off the airlock chambers 310A and 310B.

The removal system 300 also includes transfer structures 350A and 350B on the opposite side of the airlock wall 302 from the location of the transfer structures 320A and 320B. The transfer structures 350A and 350B include a platform or floor 352 composed of a plurality of spaced apart longitudinal bars 354 capable of supporting the containers 22 therein. The bars 354 are cantilevered from the base of the transfer structures 350A and 350B. The transfer structures 350A and 350B are movable in the longitudinal direction, parallel to conveyor 306, by actuating systems 360 which include transfer sections 350A and 350B moveable in the direction along the length of the conveyor 306. The actuators 360 are supported by columns 364 that depend downwardly from the overhead ceiling structure (not shown).

As in the transfer structures 320A and 320B, the transfer structures 350A and 350B also include airlock doors 362 that are configured to close off the adjacent side of the airlock chambers 310A and 310B when the transfer structures 350A and 350B are advanced toward the airlock chambers 310A and 310B. It will be appreciated that when the transfer structures 320A or 320B and the corresponding transfer structures 350A or 350B are positioned so that the airlock doors 346 and 362 close off the airlock chambers, the support bars 324 of the floor 322 nest between the support bars 354 of the floor 352.

The transfer structures 350A and 350B are also constructed to move laterally with respect to the length of conveyor belt 306 by a lateral support and actuating system 370 which includes a guideway 372 for guiding the lateral movement of the transfer structures 350A and 350B so that once the containers 22 are removed from the airlock chambers, the containers can be moved laterally onto the takeaway conveyor 314. It will be appreciated that rather than using actuating system 370, the containers 22 can be removed from the transfer structures 350A and 350B using a lateral actuating system similar to actuating system 330 described above.

Figure 13A:
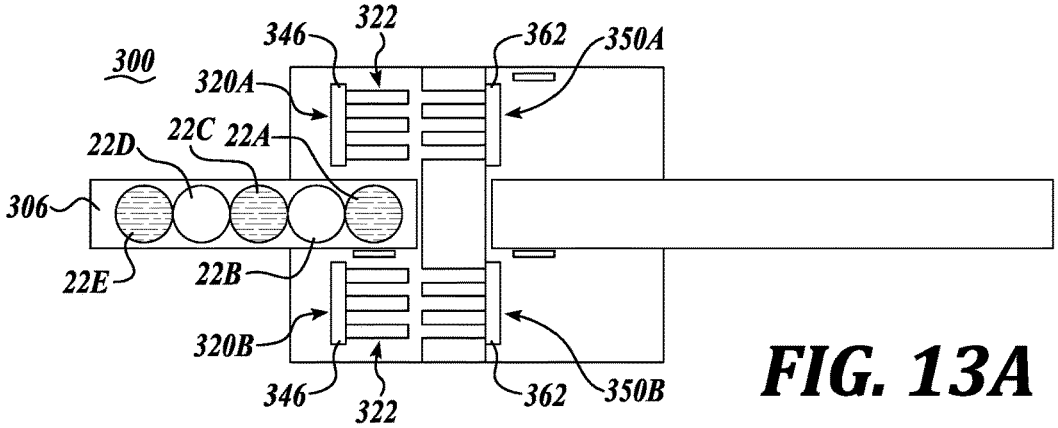
FIGS. 13A-13G illustrate the manner of operation of the alternative removal system.
Figure 13B:
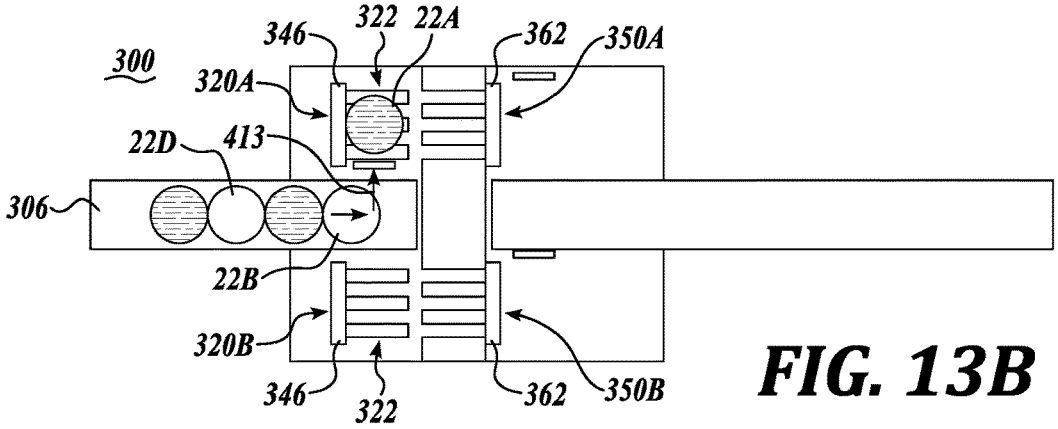
Figure 13C:
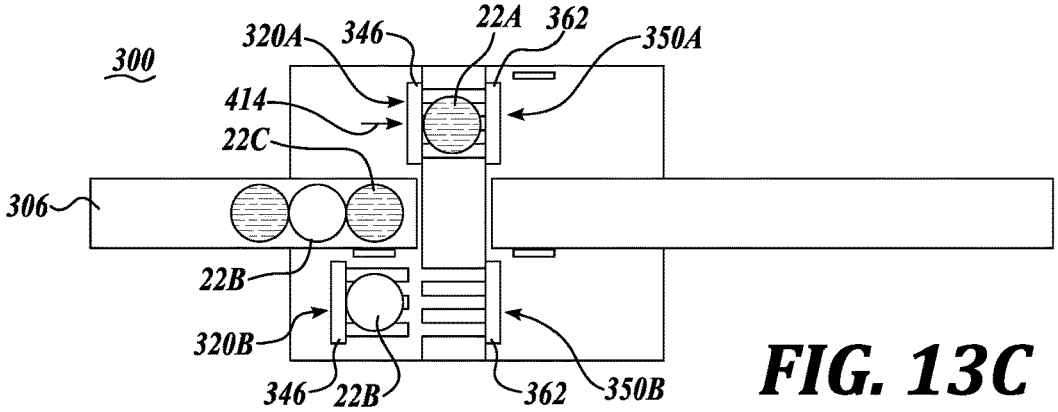
Figure 13D:
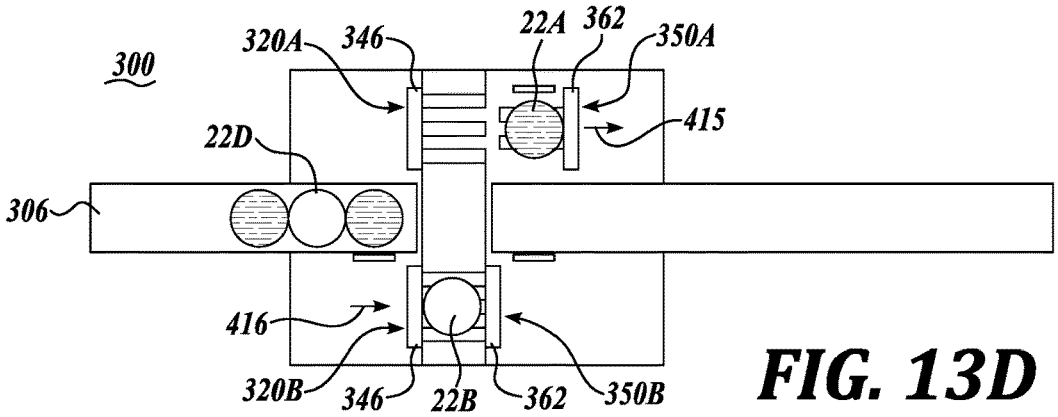
Figure 13E:
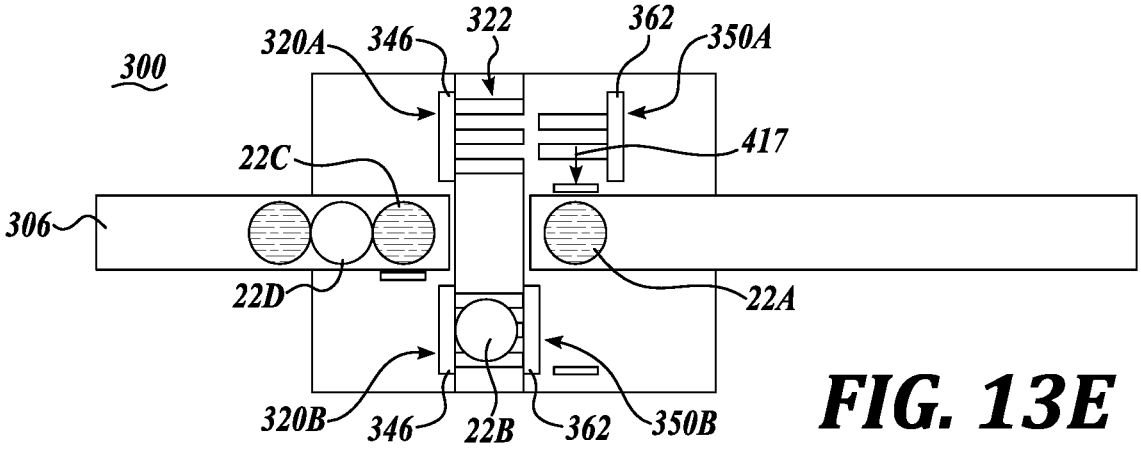
Figure 13F:
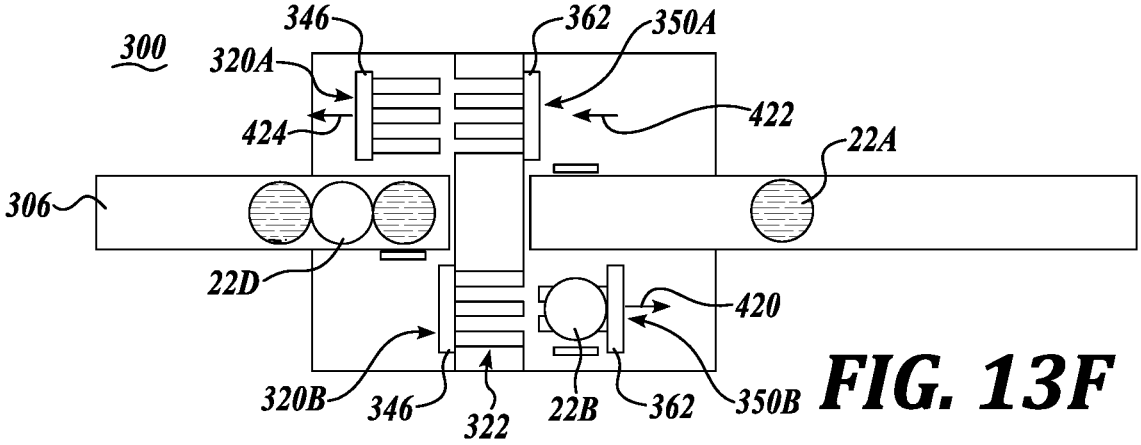
Figure 13G:
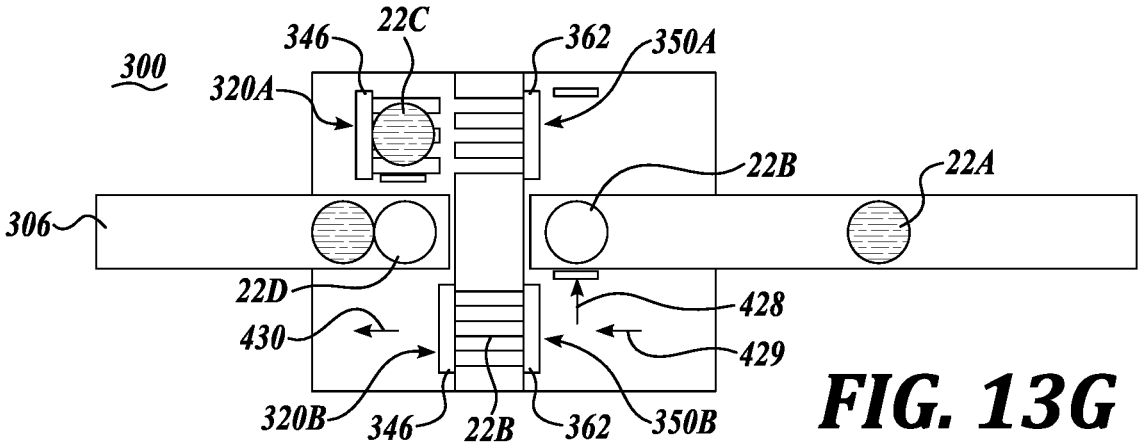
Figure 14:
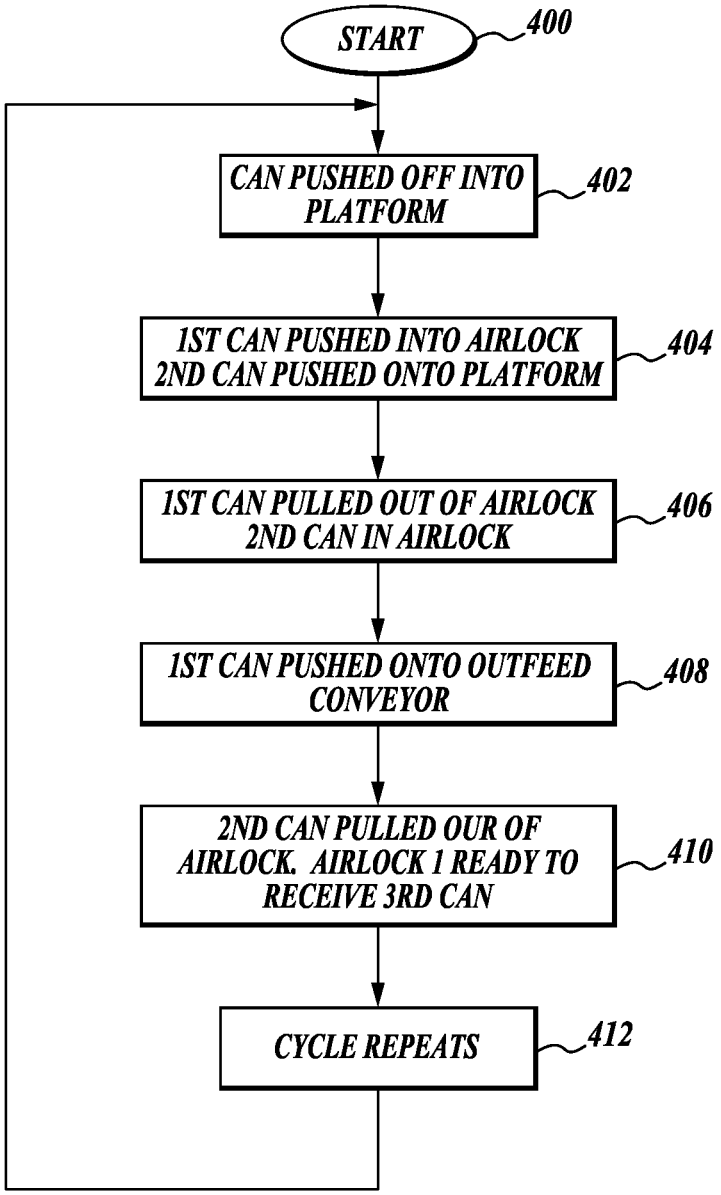
FIG. 14 is a flow diagram illustrating the operation of the alternative removal system.

The functioning of the removal system 300 is schematically illustrated in FIGS. 13A-13G as well as in the flow diagram of FIG. 14. At the start step 400 shown in FIG. 14, the containers 22 are positioned on the incoming conveyor 306 as shown in FIG. 13A. In step 402, as shown in FIG. 13B, a first container 22A is pushed laterally off of the conveyor 306 by the lateral actuator 330 and onto platform 322, see arrow 413.

In the next step 404, as shown in FIG. 13C, the container 22A is pushed into the airlock chamber 310A by the longitudinal movement of the transfer structure 320A, see arrow 414. The transfer structure 350A has already been positioned against the airlock chamber 310A. Simultaneously, a second container 22B is pushed transversely from the conveyor 306 onto platform 322 of the transfer structure 320B via lateral actuator 330.

In the next step 406, the container 22A is removed from the airlock chamber 310A by the longitudinal movement of the transfer structure 350A, as shown in FIG. 13D, see arrow 415. During this transfer process, the transfer structure 320A remains engaged with the airlock chamber 310A so as to isolate the airlock chamber from the housing between the entrance wall 304 and the airlock wall 308. Simultaneously, the container 22B is placed into the airlock chamber 310B by the longitudinal advancement of the transfer structure 320B, see arrow 416. As shown in FIG. 13D, the transfer structure 350B is already in place with the airlock door 362 sealing the adjacent side of the airlock chamber 310B.

In the next step 408, as shown in FIG. 13E, the container 22A is transferred onto the takeaway conveyor 314 by the lateral movement of the transfer structure 350A via the lateral actuating system 370, see arrow 417. As noted above, rather than using the lateral actuating system 370, the lateral transfer of the containers from the transfer structures 350A and 350B onto the takeaway conveyor 314 can be accomplished using a lateral actuator similar to lateral actuator 330 described above.

In the next step 410, as shown in FIG. 13F, the container 22B is removed from the airlock chamber 310B by the longitudinal movement of the transfer structure 350B in the direction of arrow 420. Simultaneously, the transfer structure 350A is moved longitudinally in the direction of arrow 422 so that the airlock door 362 is engaged against the adjacent end of the airlock chamber 310A. Also, the transfer structure 320A is moved longitudinally in the direction of arrow 424 away from the airlock chamber 310A to be in position to receive the next container 22C.

The cycle is shown as beginning to repeat itself in step 412 as depicted in FIG. 13G, wherein the container 22B is shifted laterally onto the takeaway conveyor 314, as shown by arrow 428, and thereafter the transfer structure 350B is positioned against the outlet side of the airlock chamber 310B, as shown by arrow 429. Thereafter, the transfer structure 320B is shifted longitudinally in the direction of arrow 430 so that the platform or floor 322 is removed from the airlock chamber 310B and is in place to receive the container 22D. Simultaneously with the foregoing, the container 22C is shifted laterally from the conveyor 206 onto the platform 322 of the transfer structure 320A.

It will be appreciated that in the foregoing manner by the use of two airlock chambers 310A and 310B, the containers 22 may be rapidly and efficiently removed from the closure/sealing station 28 so as to achieve a high throughput for the overall system 20.

Figure 15:
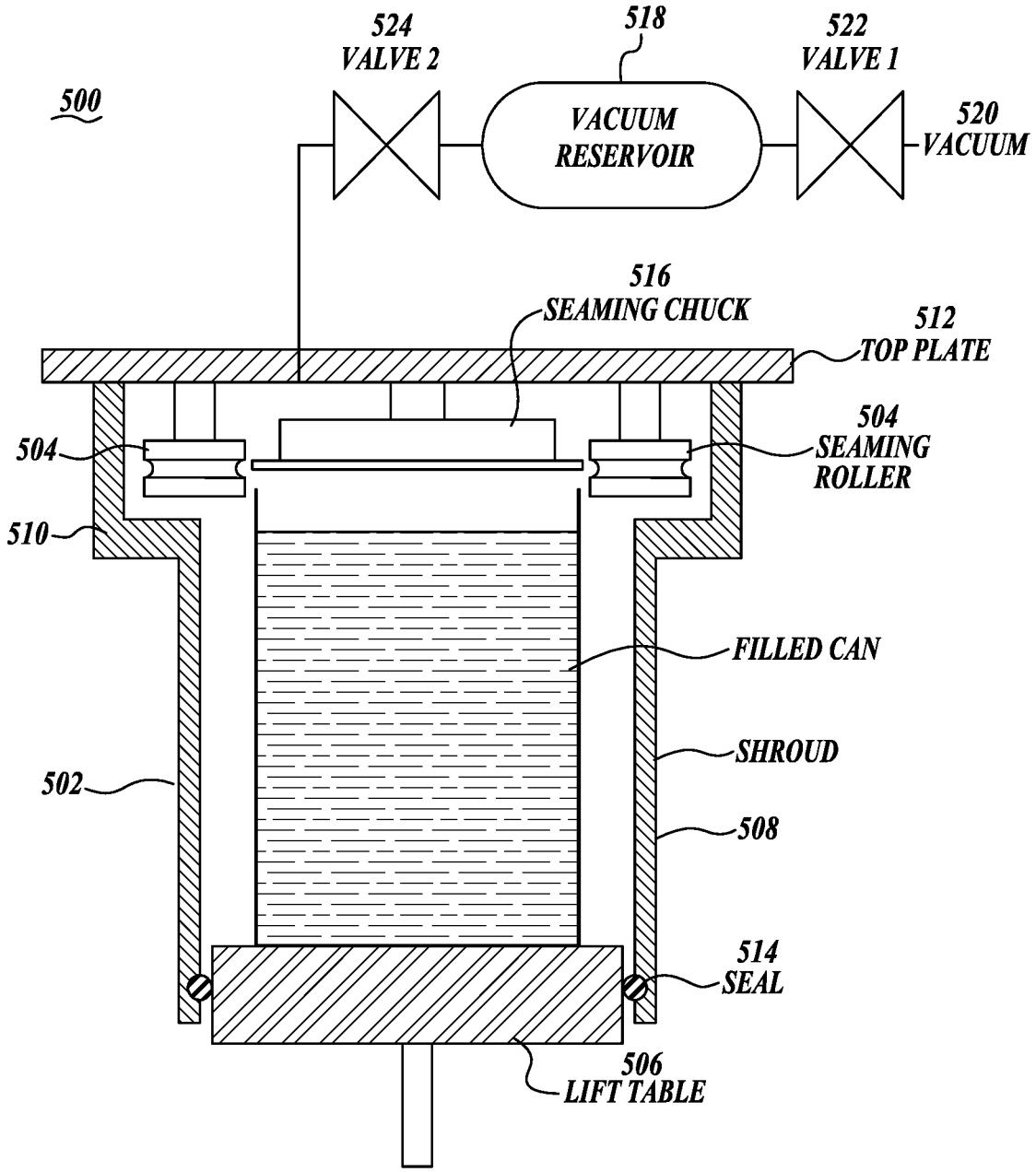
FIG. 15 is a cross-sectional schematic view of a seaming apparatus in accordance with the present disclosure.

FIG. 15 illustrates a system 500 for placing the covers 182 on containers 22 when it is needed or desirable to have a negative pressure in the container at the time of sealing the container. In this regard, an airtight shroud 502 is placed around the seaming rollers 504, and the shroud 502 is sealed to the lift table 506 of the seaming apparatus 500.

More specifically, a shroud 502 is formed with a smaller diameter lower portion 508 encircling most of the container 22 except at the upper portion thereof at the elevation of the seaming rollers 504. At the upper portion of the shroud 510, the area of the shroud is increased to accommodate the seaming rollers 504 which are outside of the perimeter of the cover 102 and container 22. The shroud upper portion 510 seals against the underside of a top plate 512. An O-ring 514 or other type of seal is used to seal the bottom of the shroud 502 against the lift table 506 of the seaming apparatus. The seaming apparatus 500 also includes a seaming chuck 516 that places the covers 182 over the top of the containers 22 and holds the cover in place while the seaming rollers 504 seal the covers 182 to the containers 22.

Before a cover 182 is attached to the top of a container 22, a pre-set vacuum is generated in a vacuum reservoir 518 using a vacuum source 520 interconnected with the vacuum reservoir 518 by a first valve 522. Just prior to seaming the cover 182 onto the container 22, a second valve 524, located between the vacuum reservoir 518 and the interior of the shroud 504, is opened to equalize the pressure between the vacuum reservoir and the interior of the shroud to the desired level, i.e., desired negative pressure. The container 22 is then sealed with the cover 182 resulting in the desired negative pressure level within the sealed container.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for evacuating and closing a filled container at a location separate from a seaming station whereat a cover is placed on the container and the cover is sealed to the container, comprising:

(a) positioning a shroud having a closed upper and an open bottom over the container thereby sealing the container from the ambient, the interior of the shroud being larger than the exterior of the container to define a volume between the exterior of the container and the interior of the shroud, and the shroud extending over the height of the container;

(b) evacuating the ambient air from the filled container and from the volume between the container and the interior of the shroud by applying a vacuum to the interior of the shroud;

(c) injecting inert gas into the shroud and the evacuated container;

(d) entrapping the contents of the filled container during the evacuation of the filled container;

(e) removing the shroud from the container;

(f) transporting the container to a seaming station while maintaining the container in an atmosphere of the inert gas; and (g) closing the filled container at the seaming station.

2. The method of claim 1, further comprising supporting the filled container on a support platform when air is evacuated from the container and shroud and replaced by an inert gas.

3. The method of claim 2, wherein the shroud is sealed against the support platform when air is evacuated from the container and shroud and replaced by an inert gas.

4. The method of claim 2, further comprising providing a plurality of filled containers and placing each of the filled containers on an individual support platform.

5. The method of claim 4, further comprising sealing each of the filled containers from the ambient by positioning a shroud over each of the filled containers.

6. The method of claim 5, wherein each of the filled containers is sealed from the ambient by sealing the shroud against the support platform of the container.

7. The method of claim 1, further comprising entrapping the contents of the filled container during the evacuation of the filled container by temporarily positioning a porous barrier over the top of the container.

8. The method of claim 1, further comprising evacuating the filled container of atmospheric air to a pressure level of about 10 to 20 mbar.

9. The method of claim 1, further comprising placing a cover on the container at the seaming station.

10. A method for evacuating air from a filled container and replacing the air with an inert gas at a location separate from the location of a seaming station whereat a cover is placed on the container and the cover is sealed to the container, comprising:

(a) positioning a shroud having a closed upper and an open bottom over the open top of a filled container thereby sealing the container from the ambient, the interior of the shroud being larger than the exterior of the container to define a volume between the exterior of the container and the interior of the shroud;

(b) evacuating the ambient air from the filled container and from the volume between the container and the interior of the shroud by applying a vacuum to the interior of the shroud;

(c) entrapping the contents of the filled container during the evacuation of the filled container;

(d) injecting an inert gas into the shroud and the evacuated container;

(e) removing the shroud from the container; and (f) transporting the container toward a seaming station while maintaining the open top of the container in an atmosphere of the inert gas.

11. The method of claim 10, further comprising supporting the filled container on a support platform when air is evacuated from the container and shroud and replaced by an inert gas.

12. The method of claim 11, wherein the shroud is sealed against the support platform when air is evacuated from the container and shroud and replaced by an inert gas.

13. The method of claim 11, further comprising providing a plurality of filled containers and placing each of the filled containers on an individual support platform.

14. The method of claim 13, further comprising sealing each of the filled containers from the ambient by positioning a shroud over each of the filled containers.

15. The method of claim 14, wherein each of the filled containers is sealed from the ambient by sealing the shroud against the support platform of the container.

16. The method of claim 10, further comprising entrapping the contents of the filled container during the evacuation of the filled container by temporarily positioning a porous barrier over the open top of the container.

17. The method of claim 10, further comprising evacuating the filled container of atmospheric air to a pressure level of about 10 to 20 mbar.

* * * * *